US007673402B2

(12) United States Patent
Wakitani et al.

(10) Patent No.: US 7,673,402 B2
(45) Date of Patent: Mar. 9, 2010

(54) SELF-PROPELLED WORK MACHINE

(75) Inventors: Tsutomu Wakitani, Wako (JP); Norikazu Shimizu, Wako (JP); Toshiaki Kawakami, Wako (JP)

(73) Assignee: Honda Motor Co., Ltd. (JP)

( * ) Notice: Subject to any disclaimer, the term of this patent is extended or adjusted under 35 U.S.C. 154(b) by 796 days.

(21) Appl. No.: 11/493,117

(22) Filed: Jul. 26, 2006

(65) Prior Publication Data

US 2007/0022636 A1 Feb. 1, 2007

(30) Foreign Application Priority Data

Jul. 29, 2005 (JP) ..... 2005-220755
Jul. 29, 2005 (JP) ..... 2005-221239
Aug. 11, 2005 (JP) ..... 2005-233566

(51) Int. Cl.
*E02F 5/02* (2006.01)

(52) U.S. Cl. ..... 37/348; 37/234

(58) Field of Classification Search ..... 37/245, 37/246, 244, 254, 382, 414, 234, 348; 701/50; 318/432, 54, 55, 59, 62; 180/19.2, 19.3, 180/65.1, 65.3, 65.5; 172/2–11
See application file for complete search history.

(56) References Cited

U.S. PATENT DOCUMENTS 6,756,750 B2 * 6/2004 Wakitani et al. ..... 318/54
6,860,348 B2 * 3/2005 Wakitani et al. ..... 180/65.1
7,487,608 B2 * 2/2009 Yamazaki et al. ..... 37/245

FOREIGN PATENT DOCUMENTS

JP 0332617 3/1991
JP 02 0142307 5/2002
JP 04 278055 10/2004

OTHER PUBLICATIONS

Patent Abstracts of Japan, publication No. 2002-14230, publication date May 17, 2002.
Patent Abstracts of Japan, publication No. 2004-278055, publication date Oct. 7, 2004.

* cited by examiner

*Primary Examiner*—Robert E Pezzuto
(74) *Attorney, Agent, or Firm*—Adams & Wilks

(57) ABSTRACT

A self-propelled work machine, in which the load of the work unit increases according to an increase in the travel speed. The self-propelled work machine includes electric motors for driving the travel units, an engine for driving the work unit, a work drive instruction unit for instructing the work unit to turn on, and a control unit for controlling the electric motors. The control unit reduces the actual speed of the electric motors by using PID control so that the actual rotational speed of the engine returns to a reference rotational speed when the actual rotational speed of the engine falls below the reference rotational speed in the state in which the work unit is turned on by the work drive instruction unit. The reference rotational speed is a reference value used when the work unit is driven by the engine.

12 Claims, 20 Drawing Sheets

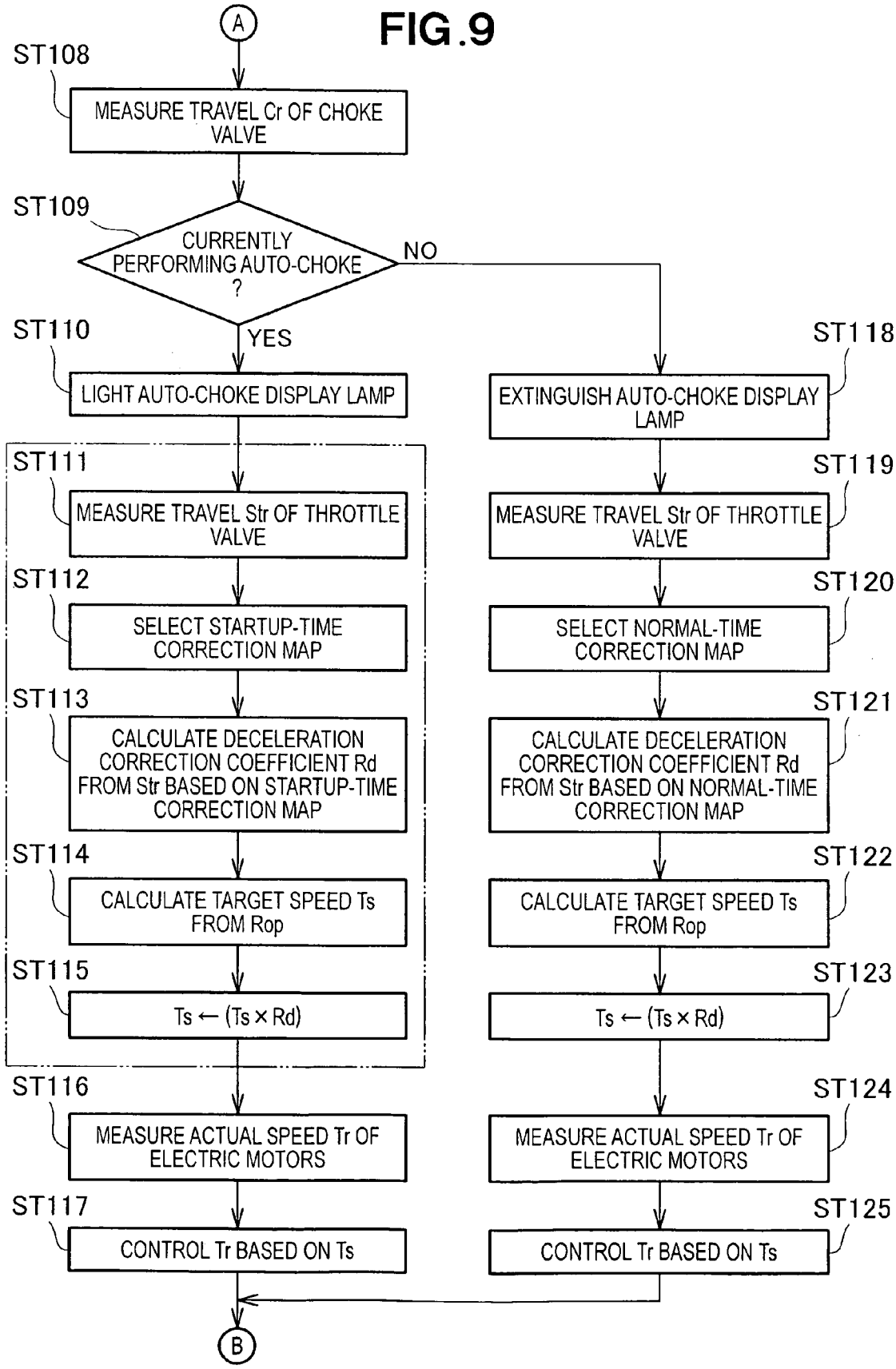
FIG.9
A
ST108
MEASURE TRAVEL Cr OF CHOKE VALVE
ST109
CURRENTLY PERFORMING AUTO-CHOKE ?
NO
YES
ST110
LIGHT AUTO-CHOKE DISPLAY LAMP
ST111
MEASURE TRAVEL Str OF THROTTLE VALVE
ST112
SELECT STARTUP-TIME CORRECTION MAP
ST113
CALCULATE DECELERATION CORRECTION COEFFICIENT Rd FROM Str BASED ON STARTUP-TIME CORRECTION MAP
ST114
CALCULATE TARGET SPEED Ts FROM Rop
ST115
Ts ← (Ts × Rd)
ST116
MEASURE ACTUAL SPEED Tr OF ELECTRIC MOTORS
ST117
CONTROL Tr BASED ON Ts
ST118
EXTINGUISH AUTO-CHOKE DISPLAY LAMP
ST119
MEASURE TRAVEL Str OF THROTTLE VALVE
ST120
SELECT NORMAL-TIME CORRECTION MAP
ST121
CALCULATE DECELERATION CORRECTION COEFFICIENT Rd FROM Str BASED ON NORMAL-TIME CORRECTION MAP
ST122
CALCULATE TARGET SPEED Ts FROM Rop
ST123
Ts ← (Ts × Rd)
ST124
MEASURE ACTUAL SPEED Tr OF ELECTRIC MOTORS
ST125
CONTROL Tr BASED ON Ts
B TRAVEL Str (%)
OF THROTTLE VALVE ACTUAL SPEED Tr
OF ELECTRIC MOTORS

SELF-PROPELLED WORK MACHINE

FIELD OF THE INVENTION

The present invention relates to a self-propelled work machine having an engine-driven work unit mounted to a machine body that can be self-propelled using an electric motor.

BACKGROUND OF THE INVENTION

The load placed on a work unit increases according to the travel speed or work conditions in some self-propelled work machines such as, for example, auger-type snow removers that are provided with an engine-driven work unit. An auger-type snow remover is a work machine in which snow is gathered and removed using an auger (work unit) at the front of the machine while the machine travels forward. As the travel speed increases, the amount of snow removed by the auger also increases. As a result, the load placed on the auger increases. This type of auger-type snow remover is described in Japanese Utility Model Laid-Open Publication No. 3-32617, and Japanese Patent Laid-Open Publication Nos. 2004-278055 and 2002-142307.

In the auger-type snow remover described in Japanese Utility Model Laid-Open Publication No. 3-32617, the travel speed of the travel unit is varied when the load placed on the auger changes according to the type or accumulated amount of snow.

In the auger-type snow remover described in Japanese Patent Laid-Open Publication No. 2004-278055, notification is given by an indicator lamp when the actual rotational speed of the engine increases or decreases in relation to a target rotational speed. The rotational speed of the engine is thereby varied according to fluctuation of the load exerted on the auger. An operator may therefore change the travel speed of the auger-type snow remover on the basis of the indication by the indicator lamp. As a result, the actual rotational speed of the engine can be matched to the target rotational speed.

In the auger-type snow remover described in Japanese Patent Laid-Open Publication No. 2002-142307, a machine body provided with a snow-removing work unit is moved along by a travel unit, and the snow-removing work unit is driven by an engine.

The auger-type snow remover (self-propelled work machine) described in Japanese Utility Model Laid-Open Publication No. 3-32617 will be described herein with reference to FIGS. 18A and 18B as an example of the abovementioned prior art. FIGS. 18A and 18B are schematic views of the conventional self-propelled work machine. FIG. 18A is a side view of the self-propelled work machine. FIG. 18B is a schematic view of the self-propelled work machine.

The conventional self-propelled work machine 100 (auger-type snow remover 100) is composed of a snow-removing work unit 101, a machine body 102 to which the snow-removing work unit 101 is provided, and a travel unit 103. The snow-removing work unit 101 is composed of an auger 111, a blower 112, and a shooter 113. The travel unit 103 is composed of a crawler. An engine constitutes a drive source 104 for driving the snow-removing work unit 101 and the travel unit 103.

In this auger-type snow remover 100, the type and accumulated amount of snow removed can be estimated by a control unit 123 on the basis of the rotational speed of the engine 104 detected by a speed sensor 121, and on the load torque of the snow-removing work unit 101 detected by a torque sensor 122. The control unit 123 controls the speed of the travel unit 103, auger 111, and blower 112 on the basis of the results of this estimation.

Specifically, the control unit 123 reduces the speed of the travel unit 103 and increases the speed of the auger 111 and blower 112 when it is estimated that the snow type is icy and the snow coverage is low in the portion of snow removed. The control unit 123 also reduces the speed of the travel unit 103, auger 111, and blower 112 when it is estimated that the snow type is regular (soft snow or the like) and the snow coverage is high.

However, it is often the case that the snow type or coverage of the portion of snow removed varies continuously. As in the auger-type snow remover 100, when the load exerted on the snow-removing work unit 101 varies according to the snow type or amount of the portion of snow removed, merely changing the travel speed of the travel unit 103 will cause frequent repetitions of deceleration and acceleration with each variation of the load. For example, frequent significant changes in the travel speed during snow removal are bothersome to the operator. Improvements can be made in order to increase ease of operation. Regardless of the travel speed or the size of the load, the speed is sometimes too low when a simple deceleration to a constant travel speed is made each time the load increases, and there is potential for improving the ease of operation in this aspect as well.

There is also potential for making it easier to operate an auger-type snow removers such as the one described in Japanese Laid-open Patent Application No. 2004-278055, wherein operation is made inconvenient by the fact that the operator must frequently change the travel speed each time the load on the auger changes according to the snow type or amount of the portion of snow removed.

Since snow is removed at low temperatures, a relatively long time is required from the time the engine 104 is started until the warm-up operation (warm-up) is completed. The operator is therefore inconvenienced by the need to wait without removing the snow until the warm-up is completed. The warm-up operation performed manually by the operator involves first closing a choke valve, and then gradually opening the choke valve according to the warm-up state.

Because of the inconvenience of this operation, the use of an automatic choke is considered. An automatic choke is a device for automatically opening and closing the choke valve according to the temperature state of the engine. The device is also referred to as an auto-choke. In other words, a configuration may be adopted in which the valve travel of the choke valve and throttle valve of the engine are adjusted by an electronic governor. Various types of such devices are known.

For example, a work machine equipped with an engine in which the valve travel of the throttle valve is adjusted by an electronic governor is described in Japanese Patent No. 2832610. In the work machine described in Japanese Patent No. 2832610, an electronic-governor throttle valve is provided to an engine mounted to a rice planting machine or a cultivator. An automatic choke may be fixed on the engine of this work machine.

An additional description will now be given with reference to FIGS. 18A and 18B. A case can be envisioned in which an electronic governor is employed for adjusting the valve travel of a choke valve and throttle valve in the engine 104 of a conventional auger-type snow remover 100. The warm-up operation is performed with the choke closed, but the load placed on the engine 104 is large when the auger-type snow remover 100 is moved forward and snow removal is started in this state.

This situation is particularly likely to occur when the travel unit 103 is made separate from the drive system actuated by the engine 104 and is part of a drive system actuated by an electric motor. This occurs because the auger-type snow remover 100 is caused to advance despite of the fact that the engine 104 is still warming up.

The performance of a common snow remover in a case in which the travel unit 103 is part of an electric motor drive system will be described with reference to FIG. 19.

FIG. 19 is a diagram describing the performance of the conventional auger-type snow remover. The drawing shows the performance of the auger-type snow remover. The elapsed time is plotted on the horizontal axis, the throttle valve travel Str is plotted on the vertical axis on the left side of the diagram, and the choke valve travel Cr and the actual speed Tr of the electric motor are plotted on the vertical axis on the right side of the diagram.

The choke valve travel Cr is 0% at t1 and 100% at t2, where t1 is the time at which the engine is started, and t2 is the time at which the warm-up operation is completed. In other words, the choke valve travel gradually increases in size from 0% to 100% according to the warm-up state.

The throttle valve travel Str increases sharply when the snow-removing work unit is driven by the engine while the travel unit is moved forward by the electric motor at about the same time as the engine is started. This is because a large load is placed on the engine. In other words, the throttle valve travel Str is unnecessarily large.

When a configuration is adopted in which the actual speed Tr of the electric motor is reduced relative to the increase in the throttle valve travel Str, the actual speed Tr of the electric motor sharply decreases with rapid increase in the throttle valve travel Str. Snow is therefore not removed by the auger-type snow remover. There is thus no point in starting to remove the snow early during warming-up of the engine. This technique leaves room for improving the ability to remove snow.

The auger-type snow remover (self-propelled work machine) described in Japanese Laid-open Patent Application No. 2002-142307 will next be described with reference to FIG. 20. FIG. 20 is a schematic diagram of a conventional self-propelled work machine.

The conventional self-propelled work machine 200 (auger-type snow remover 200) is described as being provided with a snow-removing work unit 203 composed of an auger 201 and a blower 202, an engine 205 for driving the snow-removing work unit 203 via a clutch 204, left and right travel units 206 and 206 composed of crawlers, left and right electric motors 207 and 207 for driving the travel units 206 and 206, left and right brakes 208 and 208 for applying braking to the travel units 206 and 206, a control unit 209 for controlling the electric motors 207 and 207 or the brakes 208 and 208, and various types of operating members 211, 213, 214, and 214 for issuing operating signals to the control unit 209.

The travel of the throttle valve 212 of the engine 205 can be adjusted by operating a throttle lever 211. The rotational speed of the engine 205 increases as the throttle valve 212 is opened.

The control unit 209 controls the direction or speed of rotation of the left and right electric motors 207 and 207 according to the operation of an accelerator lever 213, and controls the left and right brakes 208 and 208 according to the operation of speed adjustment levers 214 and 214.

The auger-type snow remover 200 thus configured is a type of work machine in which a snow-removing work unit 203 is driven by an engine 205, and travel units 206 and 206 are driven by electric motors 207 and 207.

By operating a clutch operating member (not shown) to switch on the clutch 204, the snow-removing work unit 203 can be driven by the power of the engine 205 to remove snow. The rotational speed of the engine 205 is reduced according to the size of the load placed on the snow-removing work unit 203. The travel of the throttle valve 212 is automatically increased according to the degree of speed reduction in order to maintain the desired rotational speed. The control unit 209 causes the travel speed of the travel units 206 and 206 to decrease by reducing the speed of the electric motors 207 and 207 according to the reduction in the rotational speed of the engine 205 or the increase of in the travel of the throttle valve 212. Specifically, the auger-type snow remover 200 is propelled at the travel speed that corresponds to the snow removal load.

The characteristics of a common auger-type snow remover 200 in a case in which the travel units 206 and 206 are driven by electric motors will next be described with reference to FIGS. 21A and 21B with reference to FIG. 20.

FIG. 21A is a timing chart in which the elapsed time is plotted on the horizontal axis, and the travel Str of the throttle valve 212 is plotted on the vertical axis. FIG. 21B is a timing chart in which the elapsed time is plotted on the horizontal axis, and the actual speed Tr of the electric motors 207 and 207 is plotted on the vertical axis. The characteristics shown in FIGS. 21A and 21B are correlated between these two diagrams.

At time t21 when the clutch 204 is switched on, a large load is placed on the snow-removing work unit 203 for an extremely short time. As a result, the rotational speed of the engine 205 begins to increase after sharply decreasing for a short time. The travel Str of the throttle valve 212 also changes rapidly for a brief time in conjunction with the rapid change in the rotational speed of the engine 205. The control unit 209 causes the actual speed Tr of the electric motors 207 and 207 to change rapidly for a brief time according to the sudden change in the rotational speed of the engine 205 or the sudden change in the travel Str of the throttle valve 212.

Since the travel speed of the auger-type snow remover 200 is generally low, an operator who is relatively skillful at removing the snow is not inconvenienced at all by this degree of variation in the travel speed. On the other hand, to a novice operator unskilled at removing the snow, travel should preferably be made as stable as possible in order to increase workability.

The same applies at time t22 or t23 when the travel Str of the throttle valve 212 is adjusted by operation of the throttle lever 211. This is because the throttle lever 211 is not necessarily operated smoothly by a novice user unaccustomed to its operation.

Therefore, a technique is needed that is capable of further enhancing the ease of operation of a self-propelled work machine provided with an engine-driven work unit in a machine body that can be self-propelled using an electric motor.

SUMMARY OF THE INVENTION

In a first aspect of the present invention, there is provided a self-propelled work machine comprising travel units and a work unit in which a load placed on the work unit increases as the travel speed of the travel units increases, the self-propelled work machine further comprising electric motors for driving the travel units, an engine for driving the work unit, a work drive instruction unit for instructing the work unit to turn on or off, and a control unit for controlling the electric motors, wherein the control unit performs proportional-integral-derivative (PID) control (control that includes the three actions consisting of proportional action, integral action, and derivative action) in which the actual speed of the electric motors is reduced so that the actual rotational speed of the engine returns to an engine reference rotational speed when it is determined that the two conditions are satisfied from among a condition wherein the instruction of the work drive instruction unit is ON, and a condition wherein the actual rotational speed of the engine is below the prescribed engine reference rotational speed when the work unit is driven by the engine.

In the self-propelled work machine, a rotational speed for the engine is set in advance as a reference for the period in which the work unit is driven by the engine, this set rotational speed is used as the engine reference rotational speed, and work can be performed while maintaining this engine reference rotational speed. For example, a rotational speed that produces substantially maximum torque in the engine may be set as the engine reference rotational speed. This is because maintaining the engine speed that produces substantially maximum torque in the engine yields the highest increase in work efficiency.

In general, the load placed on the engine increases when the load on the work unit is increased during work at the current travel speed in a self-propelled work machine in which the load placed on the work unit increases with increased travel speed, such as in an auger-type snow remover. As a result, the rotational speed of the engine decreases. The load placed on the work unit is reduced at this time by decreasing the travel speed of the self-propelled work machine. As a result, the engine can be returned to its original rotational speed.

A configuration is adopted in the self-propelled work machine whereby the actual speed of the electric motors is reduced by PID control so that the actual rotational speed of the engine returns to the engine reference rotational speed when the actual rotational speed of the engine falls below the engine reference rotational speed in a state in which the work unit is turned on by the work drive instruction unit.

Specifically, when the actual rotational speed of the engine falls below the engine reference rotational speed, the control unit determines that there is an excessive load on the engine (overloaded state) and reduces the actual speed of the electric motors. Since the travel speed of the self-propelled work machine decreases, the engine overloaded state can be overcome. As a result, the actual rotational speed of the engine can be automatically returned to the engine reference rotational speed. Operational efficiency can thus be increased while maintaining the engine reference rotational speed. By overcoming the engine overloaded state, the rate of fuel consumption (amount of fuel consumed per unit time; fuel consumption) by the engine can also be improved.

Furthermore, since the actual speed of the electric motors is PID-controlled, frequent significant variation in the travel speed can be prevented even when the load placed on the engine varies significantly and frequently, for example. Ease of operation can therefore be further enhanced without frequent significant variations in travel speed that are troublesome to the operator.

Preferably, the self-propelled work machine further comprises a target speed adjustment unit for specifying a target speed of the electric motors, wherein the control unit performs PID control so as to maintain the actual speed of the electric motors at the target speed when it is determined that the condition wherein the instruction of the work drive instruction unit is ON is satisfied, and that the actual rotational speed of the engine has returned to the engine reference rotational speed.

Desirably, the control unit performs control whereby the actual speed of the electric motors changes to the target speed of the electric motors regardless of the actual rotational speed of the engine when the condition wherein the instruction of the work drive instruction unit is ON is not satisfied.

It is also preferred that the self-propelled work machine further comprise an electronic governor for adjusting the travel of a choke valve and the travel of a throttle valve in the engine, wherein the control unit performs control so as to reduce the actual speed of the electric motors in relation to an increase in the travel of the throttle valve, and performs control so as to bring the rate at which the actual speed of the electric motors is reduced relative to an increase in the travel of the throttle valve to a lower level when a startup condition wherein the choke valve is being adjusted by the electronic governor is satisfied than when this condition is not satisfied.

It is also preferred that the control unit further comprise a startup-time correction map used during startup of the engine, wherein the startup-time correction map has a characteristic for reducing a deceleration correction coefficient for the electric motors in relation to an increase in the travel of the throttle valve so that the deceleration correction coefficient when the throttle valve is completely open is larger than zero; and the control unit calculates the deceleration correction coefficient for the current travel of the throttle valve on the basis of the startup-time correction map, multiplies the deceleration correction coefficient by the target speed to make a correction, and controls the actual speed of the electric motors at the corrected target speed when the startup condition is satisfied.

Preferably, the control unit further comprises an initial correction map used during startup of the engine, and a normal-time correction map used after startup of the engine is completed, wherein the initial correction map has a characteristic whereby an initial correction coefficient for the electric motors increases in relation to an increase in the travel of the choke valve; the normal-time correction map has a characteristic whereby a deceleration correction coefficient for the electric motors decreases in relation to an increase in the travel of the throttle valve; and the control unit calculates the initial correction coefficient for the current travel of the choke valve on the basis of the initial correction map, calculates the deceleration correction coefficient for the current travel of the throttle valve on the basis of the normal-time correction map, multiplies both the deceleration correction coefficient and the inverse of the initial correction coefficient by the target speed to make a correction, and controls the actual speed of the electric motors at the corrected target speed when the startup condition is satisfied.

It is also preferred that the self-propelled work machine further comprise a travel drive instruction unit for specifying forward movement of the travel units, wherein the control unit performs control so as to bring the rate at which the actual speed of the electric motors is reduced relative to an increase in the travel of the throttle valve to a lower level than when the choke valve is stopped, only when the three conditions are satisfied from among a condition wherein the travel drive instruction unit specifies forward movement, a condition wherein the work drive instruction unit specifies the ON state, and a condition wherein the startup condition is satisfied.

Desirably, the self-propelled work machine further comprises a rotational speed variation instruction unit for specifying a change in the rotational speed in order to change the rotational speed of the engine, wherein the control unit performs control so that the control state in which the electric motors are kept immediately prior to receiving an instruction is maintained for a prescribed specific period of time from the moment at which an instruction is received when at least one instruction is received from among the instructions of the work drive instruction unit and the rotational speed variation instruction of the rotational speed variation instruction unit.

It is also preferred that the specific period of time correspond to the time until an unstable state is overcome when a signal that affects the control of the electric motors by the control unit and is one the signals issued from the engine to the control unit becomes temporarily unstable in conjunction with at least one of the instructions.

Preferably, the control unit continuously controls the electric motors in correlation with the engine while the engine is operating.

In a second aspect of the present invention, there is provided a self-propelled work machine comprising travel units and a work unit in which a load placed on the work unit increases as the travel speed of the travel units increases, the self-propelled work machine further comprising electric motors for driving the travel units, an engine for driving the work unit, an electronic governor for adjusting the travel of a choke valve and the travel of a throttle valve in the engine, a work drive instruction unit for instructing the work unit to turn on or off, and a control unit for controlling the electric motors, wherein the control unit performs control so as to reduce the actual speed of the electric motors in relation to an increase in the travel of the throttle valve, and performs control so as to bring the rate at which the actual speed of the electric motors is reduced relative to an increase in the travel of the throttle valve to a lower level when a startup condition wherein the choke valve is being adjusted by the electronic governor is satisfied than when this condition is not satisfied. In the self-propelled work machine, control is performed so that the rate at which the travel speed decreases in relation to an increase in the travel of the throttle valve is lower in the engine startup state in which the choke valve is driven than in the state after startup is completed.

In general, in a self-propelled work machine in which the load placed on the work unit increases with increased travel speed, such as in an auger-type snow remover, there is a large load on the engine when the work unit is driven by the engine while the travel units are advanced by the electric motors at substantially the same time as the engine is started. Therefore, the travel of the throttle valve suddenly increases.

In the self-propelled work machine, the speed of the electric motors can be reduced relatively smoothly even when the throttle valve travel suddenly increases. The travel speed of the self-propelled work machine can therefore also be reduced relatively smoothly. As a result, the work performed by the work unit can be accelerated. Since the engine is thus made easier to operate during warm-up, the self-propelled work machine can also be made easier to operate.

In a third aspect of the present invention, there is provided a self-propelled work machine comprising travel units and a work unit in which a load placed on the work unit increases as the travel speed of the travel units increases, the self-propelled work machine further comprising electric motors for driving the travel units, an engine for driving the work unit, a work drive instruction unit for instructing the work unit to turn on or off, a rotational speed variation instruction unit for specifying a change in the rotational speed in order to change the rotational speed of the engine, and a control unit for controlling the electric motors, wherein the control unit performs control so that the control state in which the electric motors are kept immediately prior to receiving an instruction is maintained for a prescribed specific period of time from the moment at which an instruction is received when at least one instruction is received from among the instructions of the work drive instruction unit and the rotational speed variation instruction of the rotational speed variation instruction unit.

When an operator performs an action for activating the work unit or an action for varying the rotational speed of the engine, the control unit can therefore control the electric motors so that the control state existing immediately prior to the operator's action is maintained over a specific period of time after the action is performed. The control unit thus controls the electric motors in a stable manner irrespective of variations in the load for a specific period of time after receiving an instruction, and signal fluctuations that accompany variations in the load are ignored. Temporary fluctuation of the travel speed in the self-propelled work machine is therefore minimized, and a more stable travel state can be achieved. The self-propelled work machine can be made easier to operate as a result.

BRIEF DESCRIPTION OF THE DRAWINGS

Certain preferred embodiments of the present invention will be described in detail below, by way of example only, with reference to the accompanying drawings, in which:

FIG. 9 is a control flowchart showing the second half in the control routine of the second embodiment of the control unit shown in FIG. 2;

DETAILED DESCRIPTION OF THE PREFERRED EMBODIMENTS

Figure 1:
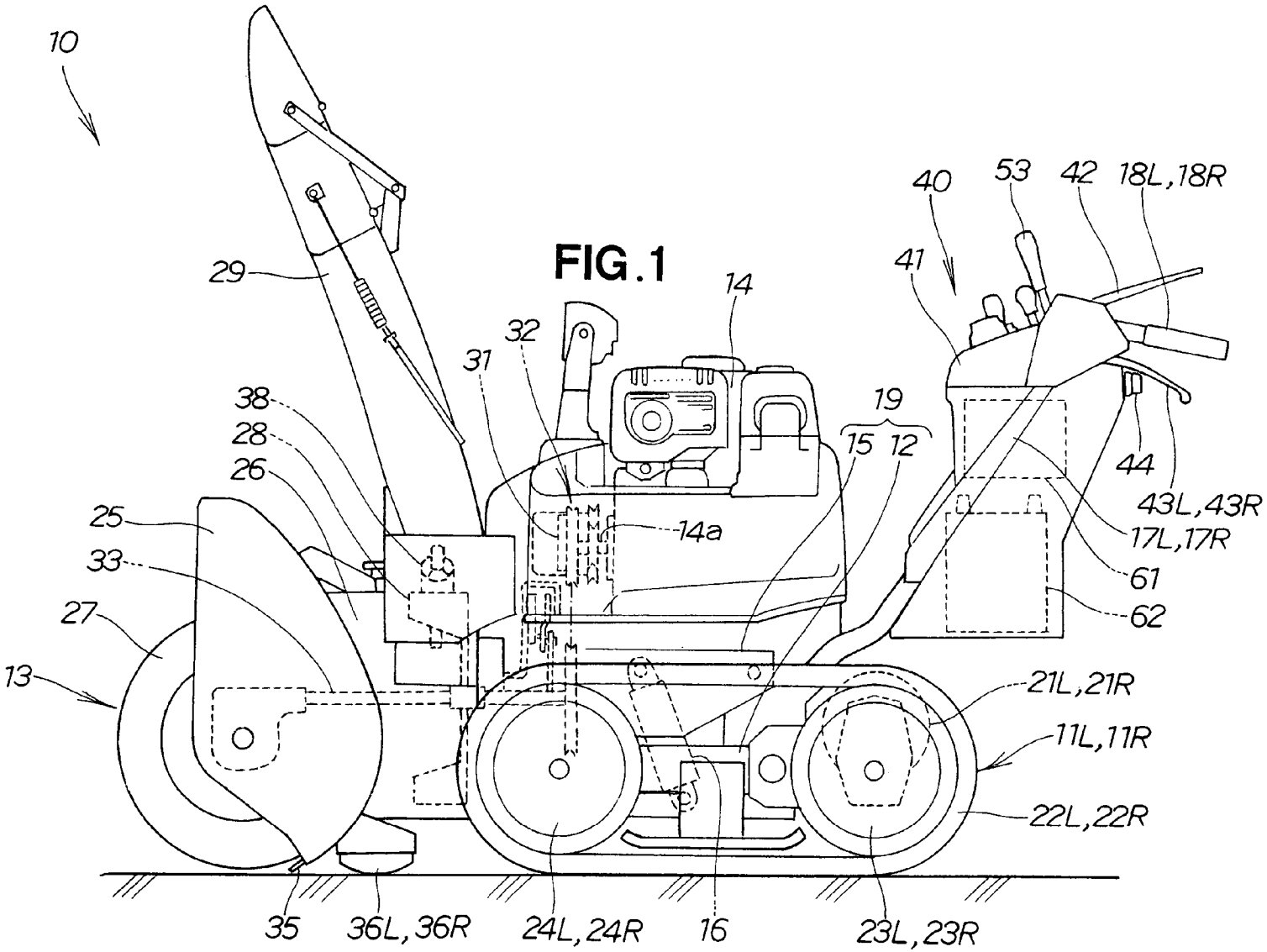
FIG. 1 is a side view showing the self-propelled work machine according to the present invention.
Figure 2:
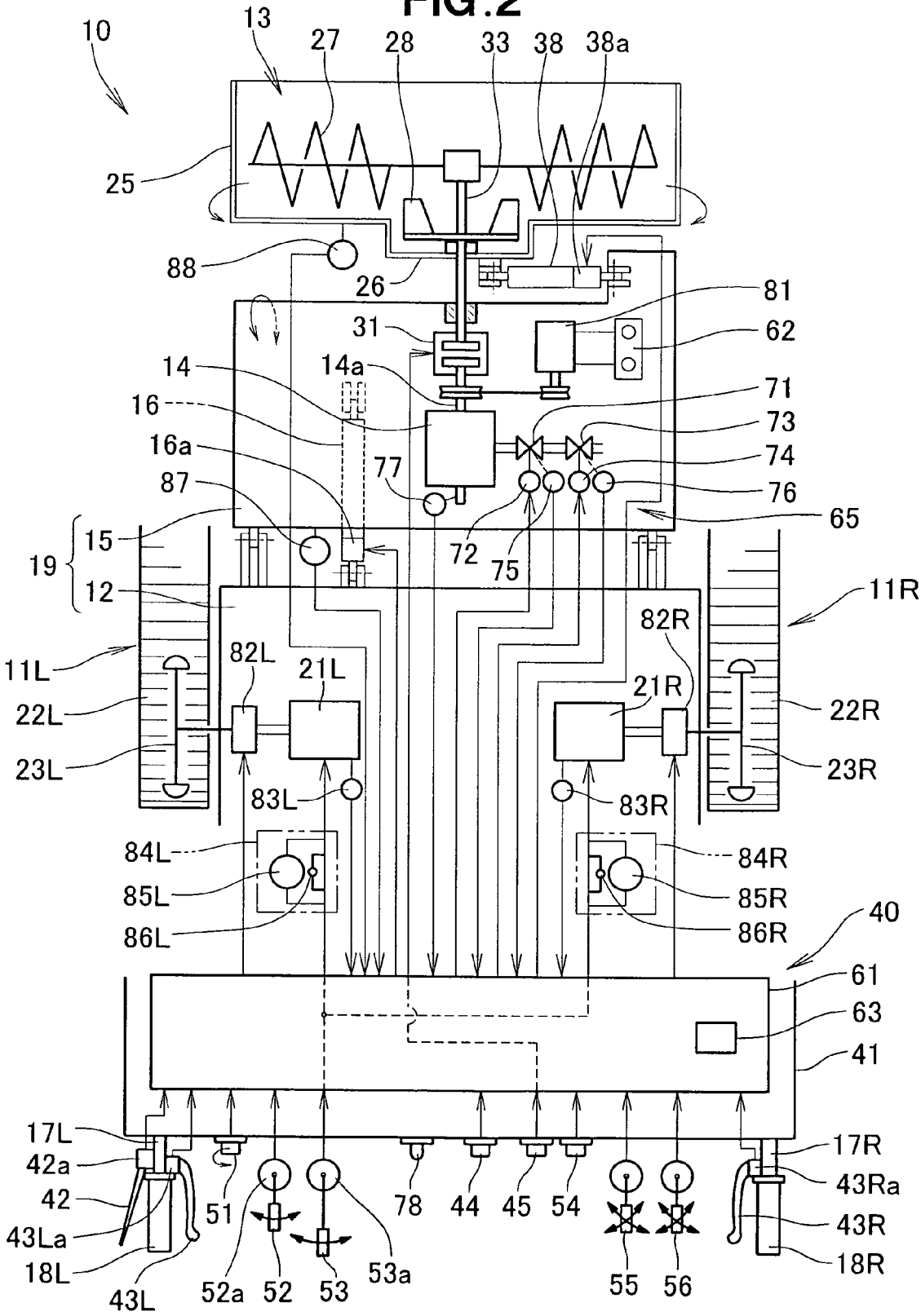
FIG. 2 is a schematic plan view of the self-propelled work machine shown in FIG. 1.

As shown in FIGS. 1 and 2, the self-propelled work machine 10 is comprised of left and right travel units 11L and 11R, left and right electric motors 21L and 21R for driving the travel units 11L and 11R, an auger-type work unit 13, an engine 14 for driving the work unit 13, and a machine body 19. This self-propelled work machine 10 is referred to as a self-propelled auger-type snow remover, and the load applied to the work unit 13 increases and decreases according to the travel speed of the travel units 11L and 11R. The self-propelled work machine 10 hereinafter will be referred to simply as the work machine 10.

The machine body 19 is composed of a travel frame 12 and a vehicle body frame 15 attached to the travel frame 12 so as to be able to swing vertically about the back end portion thereof. This machine body 19 is provided with a lift drive mechanism 16 for lifting and lowering the front portion of the vehicle body frame 15 in relation to the travel frame 12.

The lift drive mechanism 16 is an actuator whereby a piston can move in and out of a cylinder. This actuator is an electro-hydraulic cylinder in which hydraulic pressure generated by a hydraulic pump (not shown) using an electric motor 16*a* (see FIG. 2) causes a piston to move telescopically. The electric motor 16*a* is a drive source used for lifting, and the motor is built into the side portion of the cylinder of the lift drive mechanism 16.

The travel frame 12 is provided with the left and right travel units 11L and 11R, the left and right electric motors 21L and 21R, and two operating handles 17L and 17R on the left and right. The left and right operating handles 17L and 17R extend upward and to the rear from the rear of the travel frame 12, and have grips 18L and 18R at the distal ends thereof. An operator can operate the work machine 10 using the operating handles 17L and 17R while walking along with the work machine 10. The work unit 13 and the engine 14 are attached to the vehicle body frame 15.

The left and right travel units 11L and 11R are composed of left and right crawler belts 22L and 22R, left and right drive wheels 23L and 23R disposed at the rear of the travel frame 12, and left and right rolling wheels 24L and 24R disposed at the front of the travel frame 12. The left and right drive wheels 23L and 23R function as traveling wheels. The left crawler belt 22L can be independently driven via the left drive wheel 23L by the drive power of the left electric motor 21L. The right crawler belt 22R can be independently driven via the right drive wheel 23R by the drive power of the right electric motor 21R.

The work unit 13 is composed of an auger housing 25, a blower case 26 formed integrally with the back surface of the auger housing 25, an auger 27 disposed inside the auger housing 25, a blower 28 disposed inside the blower case 26, and a shooter 29 (see FIG. 1) disposed on the top of the blower case 26. The work unit 13 is further provided with an auger transmission shaft 33 for transmitting the motive force of the engine 14 to the auger 27 and the blower 28. The auger transmission shaft 33 extends to the front and back of the work machine 10, and is rotatably supported by the auger housing 25 and the blower case 26. The work unit 13 will be referred to hereinafter as the "snow-removing work unit 13" as appropriate. A scraper 35 for scraping the snow surface, and left and right skids 36L and 36R that slide on the snow surface or road surface, are provided to the bottom rear end of the auger housing 25.

The blower case 26 is attached to the front-end portion of the vehicle body frame 15 so as to be able to roll (left/right rotation; swaying). An auger housing 25 integrated with the blower case 26 is also attached to the vehicle body frame 15 so as to be able to roll. As is clear from the above description, the auger housing 25 and the blower case 26 can lift, lower, and roll in relation to the travel frame 12.

The machine body 19 is provided with a rolling drive mechanism 38 for causing the auger housing 25 and the blower case 26 to roll in relation to the travel frame 12. The rolling drive mechanism 38 is an actuator that allows a piston to move in and out of a cylinder. This actuator is a type of electrohydraulic cylinder for causing a piston to move telescopically by using hydraulic pressure generated from a hydraulic piston (not shown) in an electric motor 38*a* (see FIG. 2). The electric motor 38*a* is a drive source used for rolling, and the motor is built into the side portion of the cylinder of the rolling drive mechanism 38.

As shown in FIG. 1, the engine 14 is a snow removal drive source for driving the work unit 13 via an electro-magnetic clutch 31 and a transmission mechanism 32. The transmission mechanism 32 is a belt-type transmission mechanism in which motive force is transmitted by a belt to the auger transmission shaft 33 from the electromagnetic clutch 31 attached to a crankshaft 14*a* of the engine 14. The motive force of the engine 14 is transferred to the auger 27 and the blower 28 through the crankshaft 14*a*, the electro-magnetic clutch 31, the transmission mechanism 32, and the auger transmission shaft 33. Snow gathered by the auger 27 can be thrown clear by the blower 28 via the shooter 29.

In the work machine 10 as shown in FIG. 1, an operating unit 40, a control unit 61, and a battery 62 are mounted between the left and right operating handles 17L and 17R. The operating unit 40 will be described hereinafter.

Figure 3:
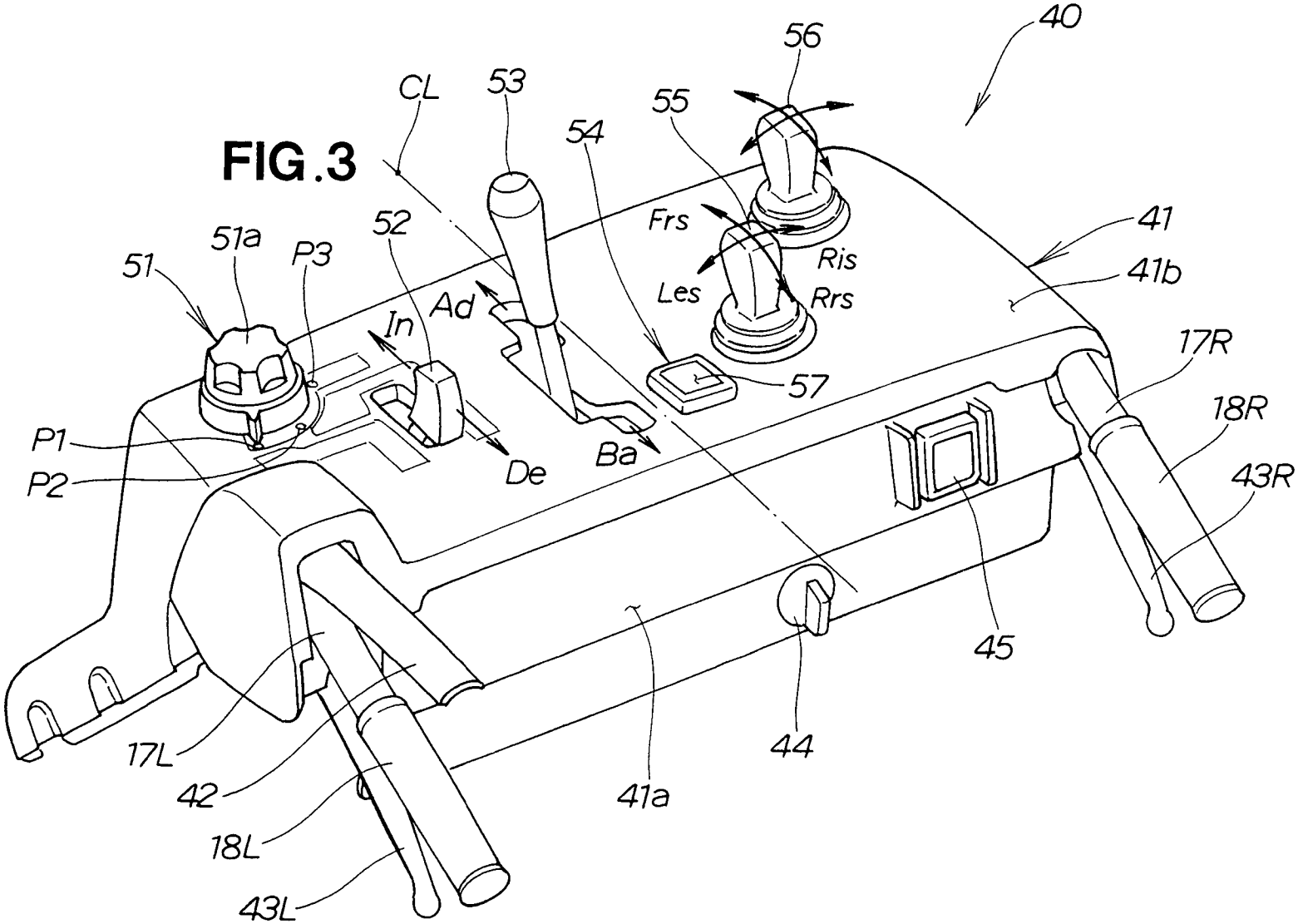
FIG. 3 is a perspective view of the operating unit shown in FIG. 1.
Figure 4:
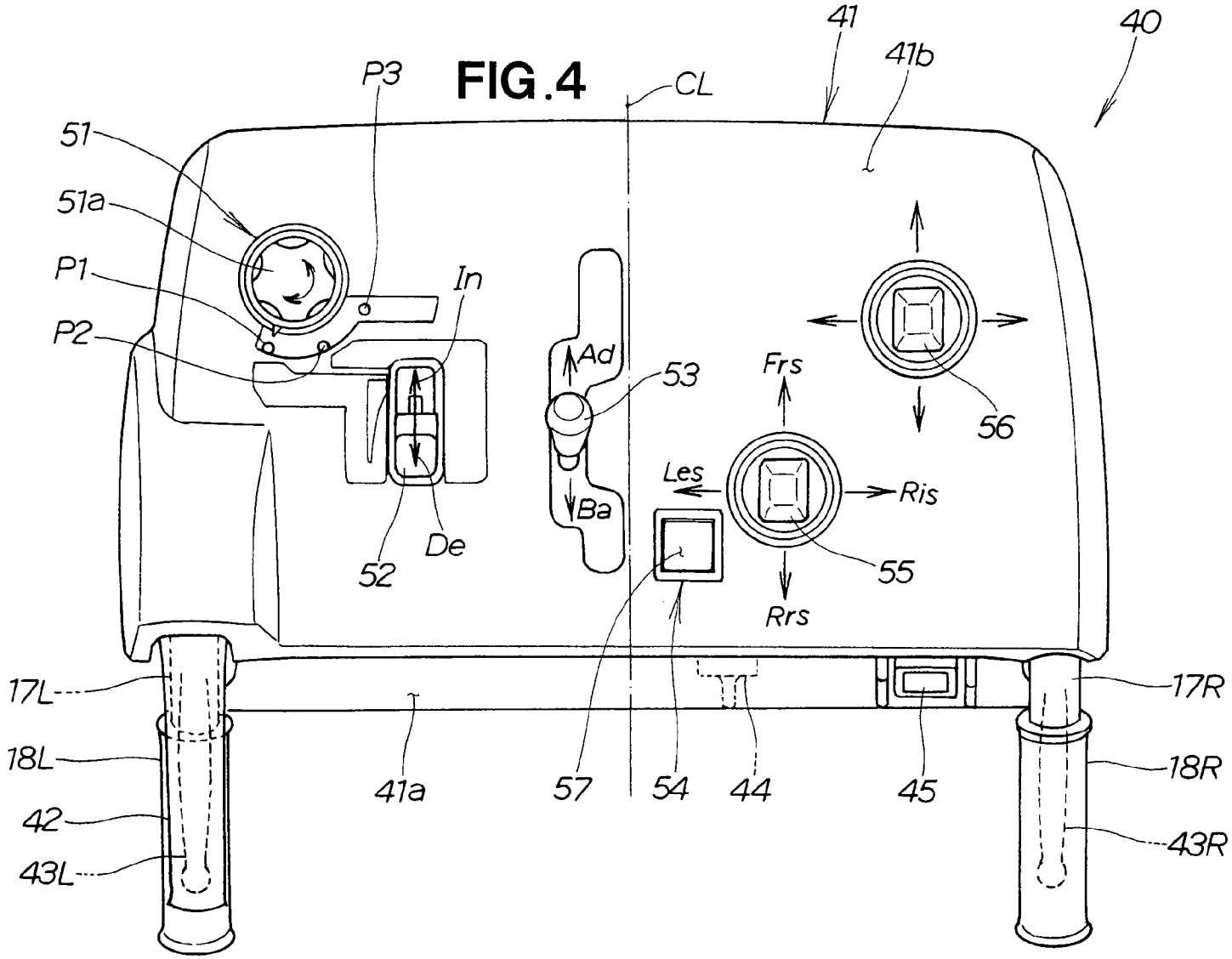
FIG. 4 is a plan view of the operating unit shown in FIG. 3.

As shown in FIGS. 3 and 4, the operating unit 40 is composed of an operating box 41, a travel preparation lever 42, a left-turn lever 43L, and a right-turn lever 43R. The operating box 41 spans the length between the left and right operating handles 17L and 17R. The travel preparation lever 42 and the left-turn lever 43L are attached near the left grip 18L to the left operating handle 17L. The right-turn lever 43R is attached near the right grip 18R to the right operating handle 17R.

The travel preparation lever 42 acts on a switch 42*a* (see FIG. 2) and is a member used to prepare for travel. The switch 42*a* is off when in the free state shown in the drawing, and is pressed into the ON state only when swung to the side of the grip 18L after the travel preparation lever 42 is grasped in the operator's left hand.

The left- and right-turn levers 43L and 43R are turn operation members that are operated by the hands that grip the left and right grips 18L and 18R, respectively, and are operating members that act on the corresponding turn switches 43La and 43Ra (see FIG. 2). The left-turn switch 43La is off when in the free state shown in FIG. 3, and is pressed into the ON state only when swung to the side of the grip 18L after the left-turn lever 43L is grasped in the left hand of the operator. The right-turn switch 43Ra is operated in the same manner. It can thereby be detected by the turn switches 43La and 43Ra whether the left- and right-turn levers 43L and 43R are being grasped.

The operating box 41 and the operating members disposed in the operating box 41 will next be described with reference to FIG. 2.

In the operating box 41 as shown in FIGS. 3 and 4, a main switch 44 and an auger switch 45 are provided to the back face 41*a* (the side that faces the operator). The main switch 44 is a manually operated power switch whereby the engine 14 can be started by turning a knob to the ON position. The auger switch 45, also referred to as the "clutch-operating switch 45" or the "work drive instruction unit 45," is a manually operated switch for switching the electromagnetic clutch 31 on and off. The switch may be composed of a push-button switch, for example.

The operating box 41 is furthermore provided with a mode switch 51, a throttle lever 52, a directional speed lever 53, a reset switch 54, an auger housing alignment lever 55, and a shooter-operating lever 56 arranged in this sequence from the left side to the right side on the upper surface 41*b* thereof. More specifically, the directional speed lever 53 is disposed on the left next to the vehicle width center CL, and the reset switch 54 is disposed on the right next to the vehicle width center CL in the upper surface 41*b* of the operating box 41.

The mode switch 51 is a manually operated switch for switching the travel control mode controlled by the control unit 61 (see FIG. 2). The switch may be composed of a rotary switch, for example. A first control position P1, a second control position P2, and a switch to a third control position P3 can be made by turning a knob 51*a* in the counterclockwise direction in the drawing. The mode switch 51 generates a switch signal in correspondence to the positions P1, P2, and P3 switched to by the knob 51*a*.

The first control position P1 is a switch position in which a switch signal indicating "first control mode" is issued to the control unit 61. The second control position P2 is a switch position in which a switch signal indicating "second control mode" is issued to the control unit 61. The third control position P3 is a switch position in which a switch signal indicating "third control mode" is issued to the control unit 61.

The first control mode is a mode wherein the travel speed of the travel units 11L and 11R is controlled according to the manual operation of the operator. This mode may also be referred to as "manual mode." For example, the operator may operate the work machine while monitoring the rotational speed of the engine 14.

The second control mode is a mode wherein the travel speed of the travel units 11L and 11R is controlled so as to be gradually reduced according to the amount of increase in the travel of the throttle valve 71. This mode may also be referred to as "power mode."

The third control mode is a mode whereby the travel speed of the travel units 11L and 11R is controlled so as to be reduced more significantly than in the second control mode according to the amount of increase in the travel of the throttle valve 71. This mode may also be referred to as "auto mode (automatic mode)."

The second and third control modes may control the travel speed of the travel units 11L and 11R in accordance with the rotational speed of the engine 14, instead of according to the travel of the throttle valve 71.

The load control modes of the control unit 61 are thus set to three modes that include (1) a first control mode for manual operation used by an advanced operator who is adequately accustomed to operating the machine, (2) a semi-automatic second control mode used by an intermediate operator who has a certain level of experience operating the machine, and (3) an automatic third control mode used by a novice operator who has no experience operating the machine. By appropriately selecting these modes, a single work machine 10 can easily be used in operating states that are optimized for novice-to-advanced operators.

The throttle lever 52 is an operating member that affects the rotation of a first control motor 72 in the electronic governor 65 (also referred to as electric governor 65) via the control unit 61. A potentiometer 52*a* issues a prescribed voltage signal (rotational speed variation instruction signal) to the control unit 61 according to the position of the throttle lever 52. The throttle lever 52 is an operating member that issues a rotational speed variation instruction to vary the rotational speed of the engine 14, and may therefore be also referred to as the "rotational speed variation instruction unit 52." The operator can swing or slide the throttle lever 52 forward and backward as indicated by arrows In and De. The throttle valve 71 can be opened and closed by operating the throttle lever 52 to cause a first control motor 72 to rotate. In other words, the rotational speed of the engine 14 can be adjusted by operating the throttle lever 52. Specifically, the throttle valve 71 can be opened all the way by moving the throttle lever 52 in the direction indicated by arrow In. The throttle valve 71 can be closed all the way by moving the throttle lever 52 in the direction indicated by arrow De.

Figure 5:
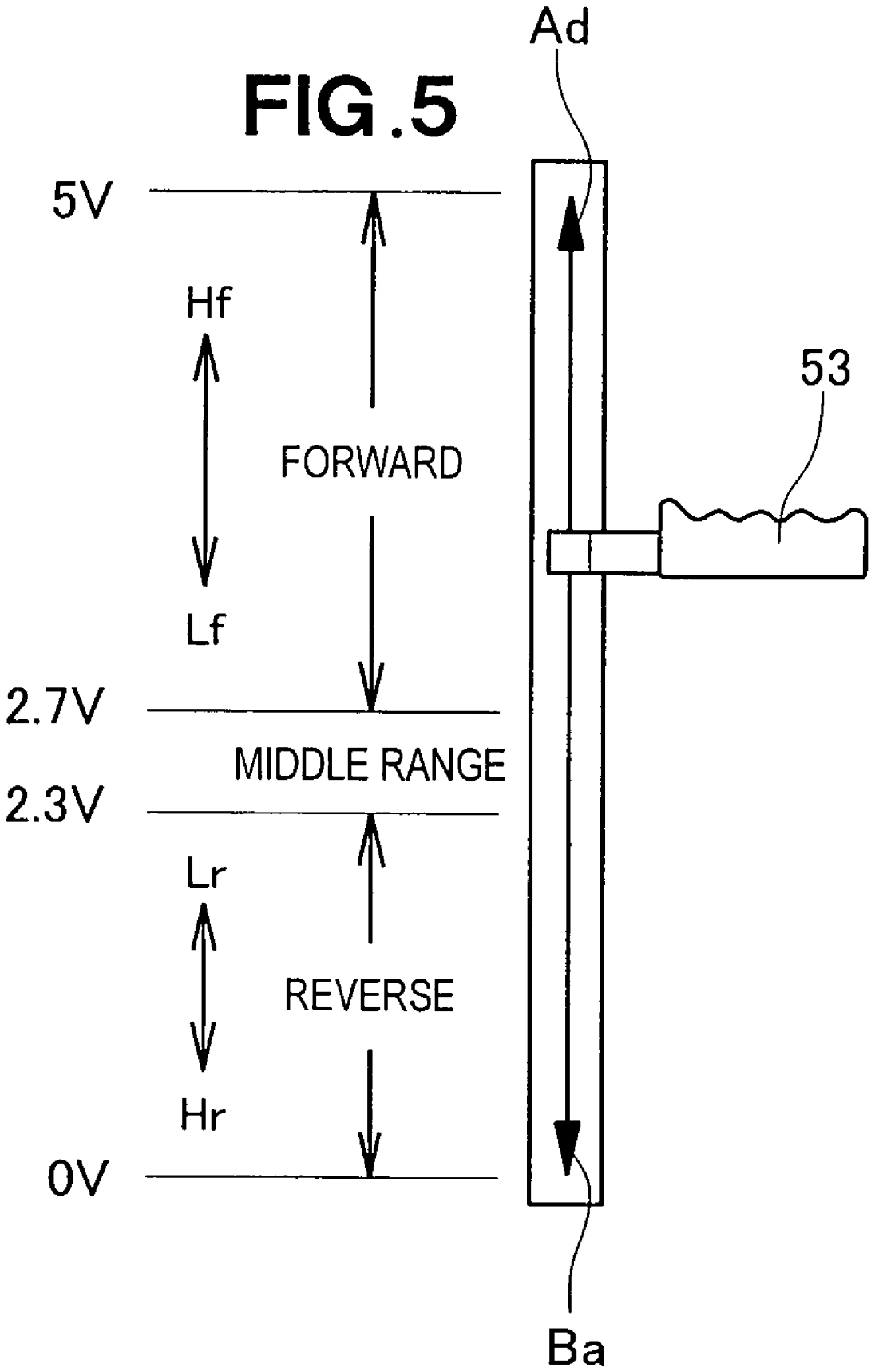
FIG. 5 is a diagram describing the operation of the directional speed lever shown in FIG. 3.

As shown in FIGS. 3 and 5, the directional speed lever 53 is an operating member for controlling the rotation of the electric motors 21L and 21R via the control unit 61. This directional speed lever 53 is also referred to as a "forward/reverse speed adjustment lever 53," a "target speed adjustment unit 53," or a "travel drive instruction unit 53," and the operator can swing or slide the directional speed lever 53 forward and backward as indicated by arrows Ad and Ba.

When the directional speed lever 53 is moved from the "middle range" to "forward," the electric motors 21L and 21R are caused to rotate forward, and the travel units 11L and 11R can be moved forward. In the "forward" region, the travel speed of the travel units 11L and 11R can be controlled so that Lf represents forward movement at low speed, and Hf represents forward movement at high speed.

In the same manner, when the directional speed lever 53 is moved from the "middle range" to "reverse," the electric motors 21L and 21R are caused to rotate backward, and the travel units 11L and 11R can be moved in reverse. In the "reverse" region, the travel speed of the travel units 11L and 11R can be controlled so that Lr represents reverse movement at low speed, and Hr represents reverse movement at high speed.

In this example, the potentiometer 52*a* (see FIG. 2) causes a voltage to be generated in accordance with the position so that the maximum speed of reverse movement occurs at 0 V (volts), the maximum speed of forward movement occurs at 5 V, and the middle range of speeds occurs at 2.3 V to 2.7 V, as indicated on the left side of FIG. 5. Forward or reverse movement and speed control between high and low speed can thus both be set by a single directional speed lever 53.

As shown in FIGS. 3 and 4, the reset switch 54 is a manual switch for restoring the alignment (position) of the auger housing 25 to a preset origin point (reference position). This reset switch 54 is also referred to as a "switch 54 for automatically returning the auger to its original position," and is composed of a push-button switch provided with a display lamp 57, for example.

The auger housing alignment lever 55 is an operating member that can swing in four directions and is used for changing the alignment of the auger housing 25. For example, when snow is being removed by the auger 27, the operator operates the alignment lever 55 so as to align the auger housing 25 with the surface of the snow. By swinging the alignment lever 55 forward Frs or backward Rrs, the auger housing 25 can be lifted and lowered by the lift drive mechanism 16. By swinging the alignment lever 55 to the left Les and to the right Ris, the auger housing 25 can be caused to roll by the rolling drive mechanism 38.

The shooter-operating lever 56 is an operating member capable of swinging in four directions in order to change the orientation of the shooter 29 (see FIG. 1).

The control system of the work machine 10 will next be described with reference to FIG. 2. The control system of the work machine 10 is centralized in the control unit 61. The control unit 61 includes memory 63 and is configured so as to appropriately read various types of information (including the control routine described hereinafter) stored in the memory 63. This control unit 61 controls the electronic governor 65, correlates the operation of the electronic governor 65 with the operation of the electric motors 21L and 21R, and controls the travel speed.

The engine 14 will first be described. The air intake system of the engine 14 is configured so that the travel of the choke valve 73 and the travel of the throttle valve 71 are adjusted by the electronic governor 65. In other words, the first control motor 72 of the electronic governor 65 automatically adjusts the travel of the throttle valve 71 on the basis of the signal of the control unit 61. The second control motor 74 of the electronic governor 65 automatically adjusts the travel of the choke valve 73 on the basis of the signal of the control unit 61.

The electronic governor 65 has an automatic choke (also referred to as auto-choke) function for automatically opening and closing the choke valve 73 according to the temperature state of the engine 14. The engine 14 can be more appropriately and easily warmed up by automatically opening and closing the choke valve 73 according to the temperature state of the engine 14 when the engine 14 is started. An auto-choke display lamp 78 (shown only in FIG. 2) can provide notification that the automatic choke is operating. The auto-choke display lamp 78 may be disposed in the operating box 41.

The engine 14 is provided with a throttle position sensor 75, a choke position sensor 76, an engine rotation sensor 77, and a generator 81. The throttle position sensor 75 detects the travel of the throttle valve 71 and issues a detection signal to the control unit 61. The choke position sensor 76 detects the travel of the choke valve 73 and issues a detection signal to the control unit 61. The engine rotation sensor 77 detects the speed of rotation (rotational speed) of the engine 14 and issues a detection signal to the control unit 61. The generator 81 is rotated by the engine 14 and feeds the resultant electrical power to a battery 62, the left and right electric motors 21L and 21R, and other electrical components.

By grasping the travel preparation lever 42 and turning the auger switch 45 ON, the electromagnetic clutch 31 can be connected (ON), and the auger 27 and blower 28 can be rotated by the motive force of the engine 14. The electromagnetic clutch 31 can be disengaged (OFF) by freeing the travel preparation lever 42 or turning off the auger switch 45.

The system that includes the travel units 11L and 11R will next be described. The work machine 10 is provided with left and right electromagnetic brakes 82L and 82R for restricting the movement of the travel units 11L and 11R. The left and right electromagnetic brakes 82L and 82R correspond to a parking brake in a normal automobile, and are configured so as to restrict the movement of the motor shafts of the left and right electric motors 21L and 21R, for example. When the machine is parked, the electromagnetic brakes 82L and 82R are placed in a braking state (ON state) by the control action of the control unit 61.

The control unit 61 releases the electromagnetic brakes 82L and 82R when all of the conditions are satisfied from among a first condition wherein the main switch 44 is in the ON position, a second condition wherein the travel preparation lever 42 is grasped, and a third condition wherein the directional speed lever 53 is in the forward movement or reverse movement position. The control unit 61 then causes the left and right electric motors 21L and 21R to rotate via left and right motor drivers 84L and 84R on the basis of information as to the position of the directional speed lever 53 obtained from a potentiometer 53*a*. The control unit 61 also executes feedback control so that the speed of rotation (rotational speed) of the electric motors 21L and 21R detected by motor rotation sensors 83L and 83R conforms to a prescribed value. As a result, the left and right travel units 11L and 11R turn at a prescribed speed in a prescribed direction, and are in a travel state.

The motor drivers 84L and 84R have regenerative brake circuits 85L and 85R and short-circuit brake circuits 86L and 86R. The short-circuit brake circuits 86L and 86R are a type of braking means.

When the left-turn lever 43L is being grasped and the left-turn switch 43La is turned ON, the control unit 61 actuates the left regenerative brake circuit 85L on the basis of the switch-ON signal thus generated. As a result, the speed of the left electric motor 21L decreases. The work machine 10 can therefore be turned left only when the left-turn lever 43L is grasped.

When the right-turn lever 43R is being grasped and the right-turn switch 43Ra is turned ON, the control unit 61 actuates the right regenerative brake circuit 85R on the basis of the switch-ON signal thus generated. As a result, the speed of the right electric motor 21R decreases. The work machine 10 can therefore be turned right only when the right-turn lever 43R is grasped.

The travel units 11L and 11R can be stopped and the electromagnetic brakes 82L and 82R returned to the braking state by performing any of the operations that include (i) returning the main switch 44 to the OFF position, (ii) releasing the travel preparation lever 42, or (iii) returning the directional speed lever 53 to the middle position.

The system that includes the auger housing 25 will next be described. When the auger housing alignment lever 55 is swung forward or backward, the electric motor 16*a* rotates forward or backward and the piston of the lift drive mechanism 16 extends or retracts according to the control signal of the control unit 61. As a result, the auger housing 25 and the blower case 26 are lifted or lowered. When the auger housing alignment lever 55 is swung to the left or right, the electric motor 38*a* rotates forward and the piston of the rolling drive mechanism 38 is extended or retracted according to the control signal of the control unit 61. As a result, the auger housing 25 and the blower case 26 perform a rolling movement.

The work machine 10 is provided with a height position sensor 87 and a rolling position sensor 88. The height position sensor 87 (vertical movement detector 87) detects the lift position of the auger housing 25 and issues a detection signal to the control unit 61. The rolling position sensor 88 (left/right tilt detector 88) detects the rolling position of the auger housing 25 and issues a detection signal to the control unit 61.

A plurality of control routines will next be described for each embodiment in a case in which the control unit 61 shown in FIG. 2 is a microcomputer. The plurality of control routines is executed by a single control unit 61. These control routines initiate control when the main switch 44 is turned ON, for example, and end control when the main switch 44 is turned OFF. The description hereinafter will be given with reference to FIGS. 2 and 4.

A first embodiment of the control routine will first be described with reference to FIG. 6.

Step (hereinafter abbreviated as ST) ST01: The position signal (i.e., the signal indicating the operating position and control input Rop of the directional speed lever 53) of the directional speed lever 53 is read. This position signal is a target speed instruction issued for the electric motors 21L and 21R by the potentiometer 53*a* of the directional speed lever 53.

ST02: The operating position of the directional speed lever 53 is determined, and the process proceeds to the next step according to the result. If the operating position is the "middle position," it is determined that stop control will be performed next, and the process proceeds to ST03. If the operating position is the "reverse movement position," it is determined that reverse travel control will be performed next, and the process proceeds to ST04. If the operating position is the "forward movement position," it is determined that forward travel control will be performed next, and the process proceeds to ST05.

ST03: After the electric motors 21L and 21R are stopped or kept in a stopped state, the process returns to ST01. As a result, the travel units 11L and 11R are stopped or kept in a stopped state.

ST04: After control for reversing the rotation of the electric motors 21L and 21R is performed, i.e., reverse movement control (reverse rotation control) is executed, the process returns to ST01. As a result, the travel units 11L and 11R are caused to travel in reverse or are kept in a state of reverse travel.

ST05: The switch signal of the auger switch 45 is read.

ST06: It is determined whether the auger switch 45 is ON. If NO, then the process proceeds to ST07. If YES, then the process proceeds to ST08.

ST07: After the electromagnetic clutch 31 is switched OFF, the process proceeds to ST11. As a result, the work unit 13 is stopped or kept in a stopped state.

ST08: The electromagnetic clutch 31 is switched ON. As a result, the work unit 13 is actuated by the motive force of the engine 14.

ST09: The actual rotational speed Ne (hereinafter referred to as the "actual rotational speed Ne") of the engine 14 is measured. The detection signal from the engine rotation sensor 77 may be read as the actual rotational speed Ne.

ST10: It is determined whether the actual rotational speed Ne of the engine has reached or exceeded (Ne≧Ns) a certain preset engine reference rotational speed Ns. If YES, then the process proceeds to ST11, and if NO, then the process proceeds to ST12. The "engine reference rotational speed Ns" herein is set in advance. This speed refers to a rotational speed Ns of the engine 14 that is used as a reference when the work unit 13 is driven by the engine 14. For example, the rotational speed of the engine 14 when the engine 14 is generating maximum torque is designated as the "engine reference rotational speed Ns."

When the engine 14 changes from low-speed rotation to high-speed rotation during operation, the work condition is generally considered to be such that the load placed on the work unit 13 is low. On the other hand, when the engine 14 changes from high-speed rotation to low-speed rotation, the work condition is considered to be such that the load placed on the work unit 13 is high. In ST10, if "Ne≧Ns," then the load placed on the engine 14 is determined to be normal (normal load) or not present, and the outcome is YES. If the actual rotational speed Ne is below the engine reference rotational speed Ns (Ne<Ns), then the load placed on the engine 14 is determined to be excessive (overload), and the outcome is NO.

ST11: The process proceeds to ST13 after the target speed Ts (target rotational speed Ts) of the electric motors 21L and 21R is calculated based on the amount Rop that the directional speed lever 53 is moved. The target speed Ts is proportional to the amount Rop.

ST12: Since the load placed on the engine 14 is excessive, the target speed Ts is reduced so as to overcome this overloaded state. Specifically, after the target speed Ts calculated in ST11 is reduced by PID control to make a correction until the condition "Ne≧Ns" is satisfied, the process proceeds to ST13. The PID control referred to herein is a general control system that includes the three actions consisting of proportional action, integral action, and derivative action (the same hereinafter).

ST13: The actual speed Tr (actual speed of rotation Tr; hereinafter referred to as "actual speed Tr") of the electric motors 21L and 21R is measured, after which the process proceeds to ST14. The detection signal from the motor rotation sensors 83L and 83R may be read as the actual speed Tr.

ST14: The electric motors 21L and 21R are controlled so as to rotate forward at the target speed Ts, after which the process returns to ST01. Specifically, forward movement (forward rotation) of the electric motors 21L and 21R is controlled by PID control so that the actual speed Tr of the electric motors 21L and 21R conforms to the target speed Ts. As a result, the travel units 11L and 11R are moved forward or kept in a state of forward motion. The target speed Ts in this case is the target speed Ts calculated in ST11 or the target speed Ts corrected in ST12.

The operation of a work machine 10 provided with a control unit 61 having the control routine according to the first embodiment will next be described with reference to FIGS. 7A and 7B and with reference to FIGS. 2 and 6.

Figure 7A:
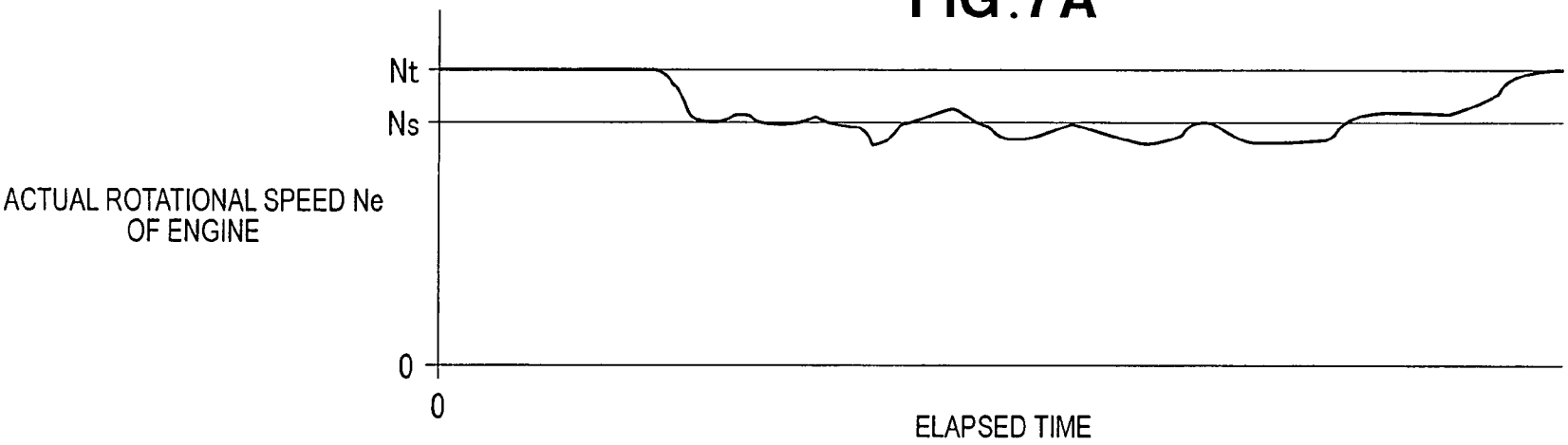
FIGS. 7A and 7B are diagrams describing the characteristics of the self-propelled work machine on the basis of the control routine of the first embodiment shown in FIG. 6.

FIG. 7A is a time chart in which elapsed time is plotted on the horizontal axis, and the actual rotational speed Ne of the engine 14 is plotted on the vertical axis. FIG. 7B is a time chart in which elapsed time is plotted on the horizontal axis, and the actual speed Tr of the electric motors 21L and 21R is plotted on the vertical axis. The values shown in FIGS. 7A and 7B are correlated between these two diagrams.

When the auger switch 45 is OFF, i.e., the work unit 13 is stopped, the actual rotational speed Ne of the engine 14 is the value Nt (Ne=Nt), and is above the engine reference rotational speed Ns, as shown in FIG. 7A. The control unit 61 executes PID control so that the actual speed Tr of the electric motors 21L and 21R conforms to the target speed Ts.

When the auger switch 45 is turned ON (ST06) during travel of the work machine 10, the work unit 13 begins the snow removal operation (ST08). Since the load placed on the work unit 13 increases, the load placed on the engine 14 also increases. As a result, the actual rotational speed Ne of the engine 14 decreases as shown in FIG. 7A. If this situation remains unchanged, then the actual rotational speed Ne of the engine 14 will fall below the engine reference rotational speed Ns.

In contrast, the control unit 61 decreases the actual speed Tr of the electric motors 21L and 21R by using PID control until the actual rotational speed Ne of the engine 14 returns to the engine reference rotational speed Ns. More specifically, the control unit 61 corrects the target speed Ts (ST12) downward by PID control so that "Ne=Ns" (ST10), and performs PID control (ST14) of the actual speed Tr of the electric motors 21L and 21R by using the corrected target speed Ts as a reference.

The actual speed Tr of the electric motors 21L and 21R is thus reduced according to the size of the load placed on the engine 14. As a result, the engine reference rotational speed Ns (for example, the rotational speed of the engine 14 when the substantially maximum torque is produced by the engine 14) can be maintained.

Since the actual speed Tr of the electric motors 21L and 21R is also increased or decreased by PID control so that the condition Ne=Ns is satisfied even when the load fluctuates, frequent significant fluctuation of the travel speed of the work machine 10 can be reduced.

The snow removal operation by the work unit 13 is then completed, whereupon the work unit 13 is brought to a load-free state. The engine 14 is also in a load-free state. As shown in FIG. 7A, the actual rotational speed Ne of the engine 14 returns to the original Nt (Ns<Nt). Accordingly, as shown in FIG. 7B, the actual speed Tr of the electric motors 21L and 21R returns to the original target speed Ts.

Figure 6:
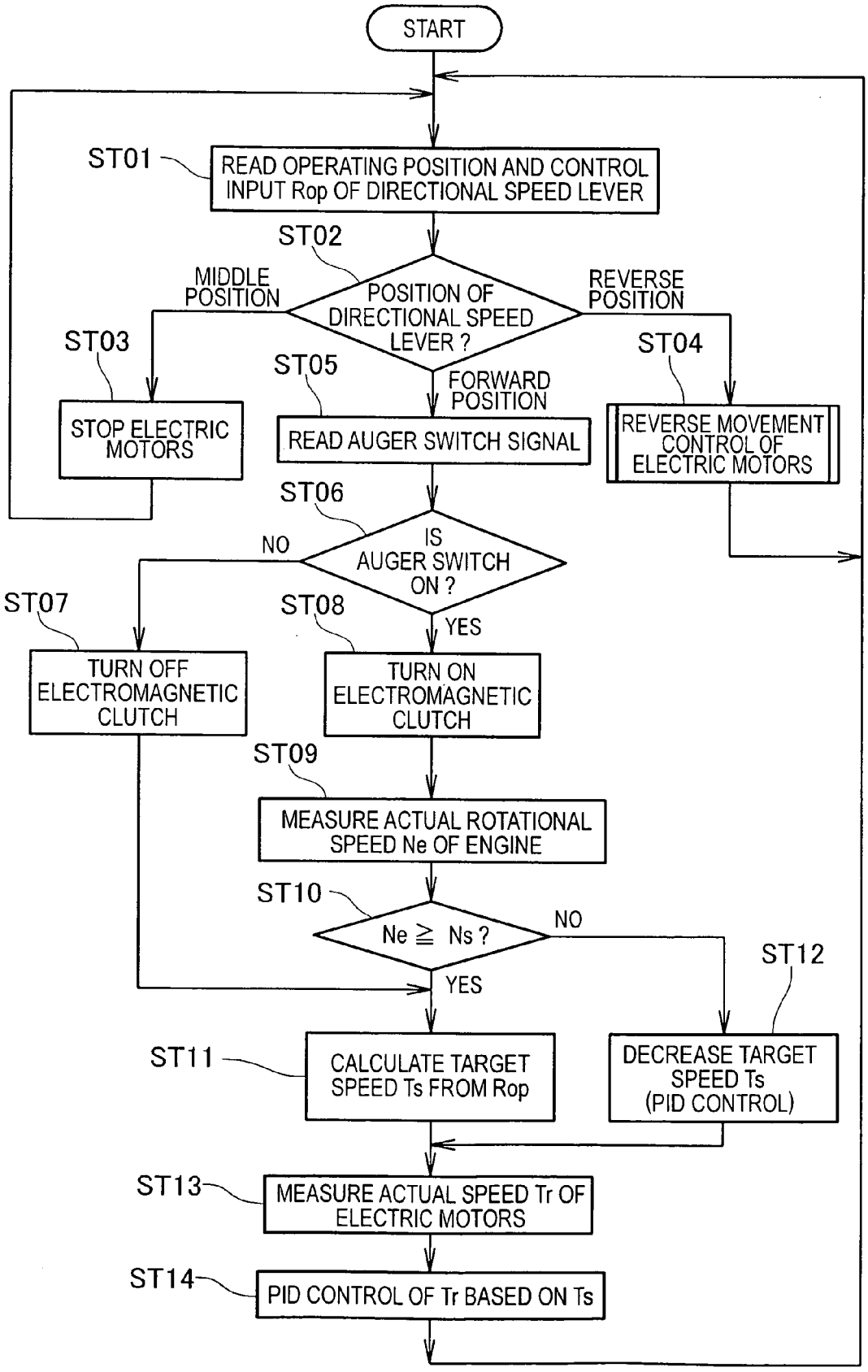
FIG. 6 is a control flowchart according to a first embodiment of the control unit shown in FIG. 2.
Figure 7B:
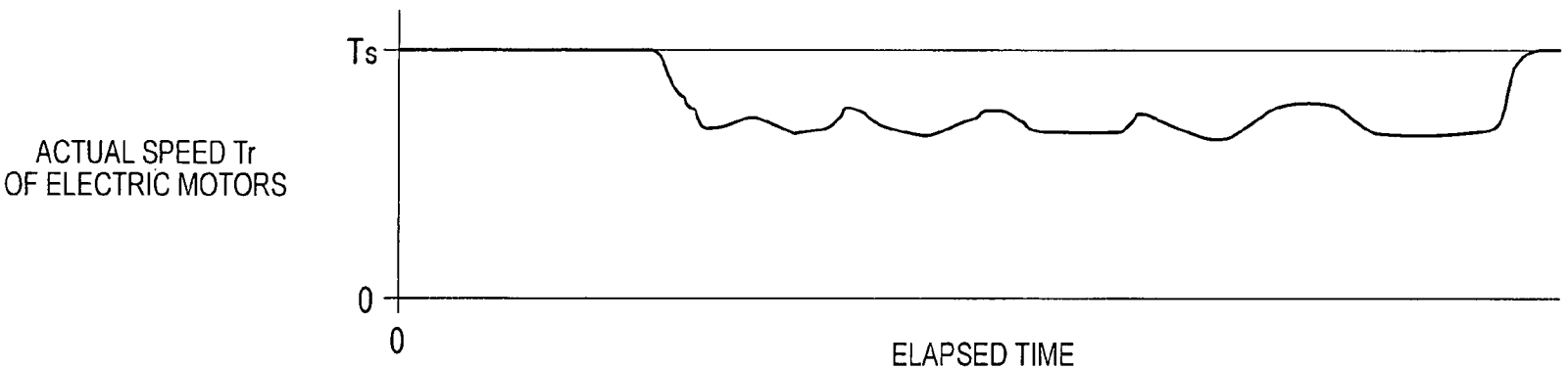

As described above, the following effects are demonstrated in the control unit 61 by the control routine of the first embodiment shown in FIG. 6.

The control unit 61 is configured so that a rotational speed Ns for the engine is set in advance as a reference for the period in which the work unit 13 is driven by the engine 14, this set rotational speed Ns is used as the engine reference rotational speed Ns, and work can be performed while maintaining this engine reference rotational speed Ns. For example, the rotational speed that produces substantially maximum torque in the engine 14 may be set as the engine reference rotational speed Ns. This is because maintaining the engine speed that produces substantially maximum torque in the engine 14 yields the highest increase in work efficiency.

In general, the load placed on the engine 14 increases when the load on the work unit 13 is increased during work at the current travel speed in a work machine 10 in which the load placed on the work unit 13 increases with increased travel speed, such as in an auger-type snow remover. As a result, the actual rotational speed Ne of the engine 14 decreases. The load placed on the work unit 13 is reduced at this time by decreasing the travel speed of the work machine 10. As a result, the actual rotational speed Ne of the engine 14 can be returned to the original rotational speed.

In the control unit 61, the actual speed Tr of the electric motors 21L and 21R is reduced by PID control so that the actual rotational speed Ne of the engine 14 returns to the engine reference rotational speed Ns when the actual rotational speed Ne of the engine 14 falls below the engine reference rotational speed Ns in a state in which the work unit 13 is turned ON by the auger switch 45 (work drive instruction unit 45).

Specifically, when the actual rotational speed Ne of the engine 14 falls below the engine reference rotational speed Ns, the control unit 61 determines that there is an excessive load on the engine 14 (overloaded state) and reduces the actual speed Tr of the electric motors 21L and 21R. Since the travel speed of the work machine 10 decreases, the overloaded state in the engine 14 can be overcome. As a result, the actual rotational speed Ne of the engine 14 can be returned to the engine reference rotational speed Ns. Operational efficiency can thus be increased while maintaining the engine reference rotational speed Ns. By overcoming overloaded state, the rate of fuel consumption (amount of fuel consumed per unit time; fuel consumption) by the engine 14 can also be improved.

Furthermore, since the actual speed Tr of the electric motors 21L and 21R is PID-controlled, frequent significant variation in the travel speed of the work machine 10 can be prevented even when the load placed on the engine varies significantly and frequently, for example. For example, fluctuation in the travel speed can be even further reduced in comparison with a case in which another control system is employed, i.e., in comparison with a control system in which a "map" is employed for reducing the actual speed Tr of the electric motors 21L and 21R in accordance with the actual rotational speed Ne of the engine 14. Ease of operation can therefore be further enhanced without frequent significant variations in travel speed that are troublesome to the operator.

The control unit 61 also executes PID control so that the actual speed Tr of the electric motors 21L and 21R conforms to the target speed Ts specified by the directional speed lever 53 (target speed adjustment unit 53) when it is determined that the actual rotational speed Ne of the engine 14 has returned to the engine reference rotational speed Ns in a state (drive state) in which the work unit 13 is turned ON by the auger switch 45.

In other words, when the actual rotational speed Ne of the engine 14 has reached the engine reference rotational speed Ns, a normal load state or a load-free state can be considered to be in effect. At this time, since the travel speed of the work machine 10 is increased, the work performed by the work unit 13 can be performed more rapidly. As a result, the operating efficiency of the work machine 10 is increased, and ease of operation can be further enhanced.

The control unit 61 also performs control whereby the actual speed Tr of the electric motors 21L and 21R changes to the target speed Ts specified by the directional speed lever 53 regardless of the actual rotational speed Ne of the engine 14 in a state (stop state) in which the work unit 13 is turned OFF by the auger switch 45.

When the work unit 13 is turned OFF by the auger switch 45, a load-free state is established in which work is not performed. Since the travel speed of the work machine 10 is increased at this time, the work machine 10 can be caused to travel more rapidly.

The configuration of the control routine of the first embodiment performed by the control unit 61 as described above with reference to FIG. 6 is best applied to the third control mode used when a switch to the third control position P3 is made by the abovementioned mode switch 51 (see FIG. 3), for example.

Figure 8:
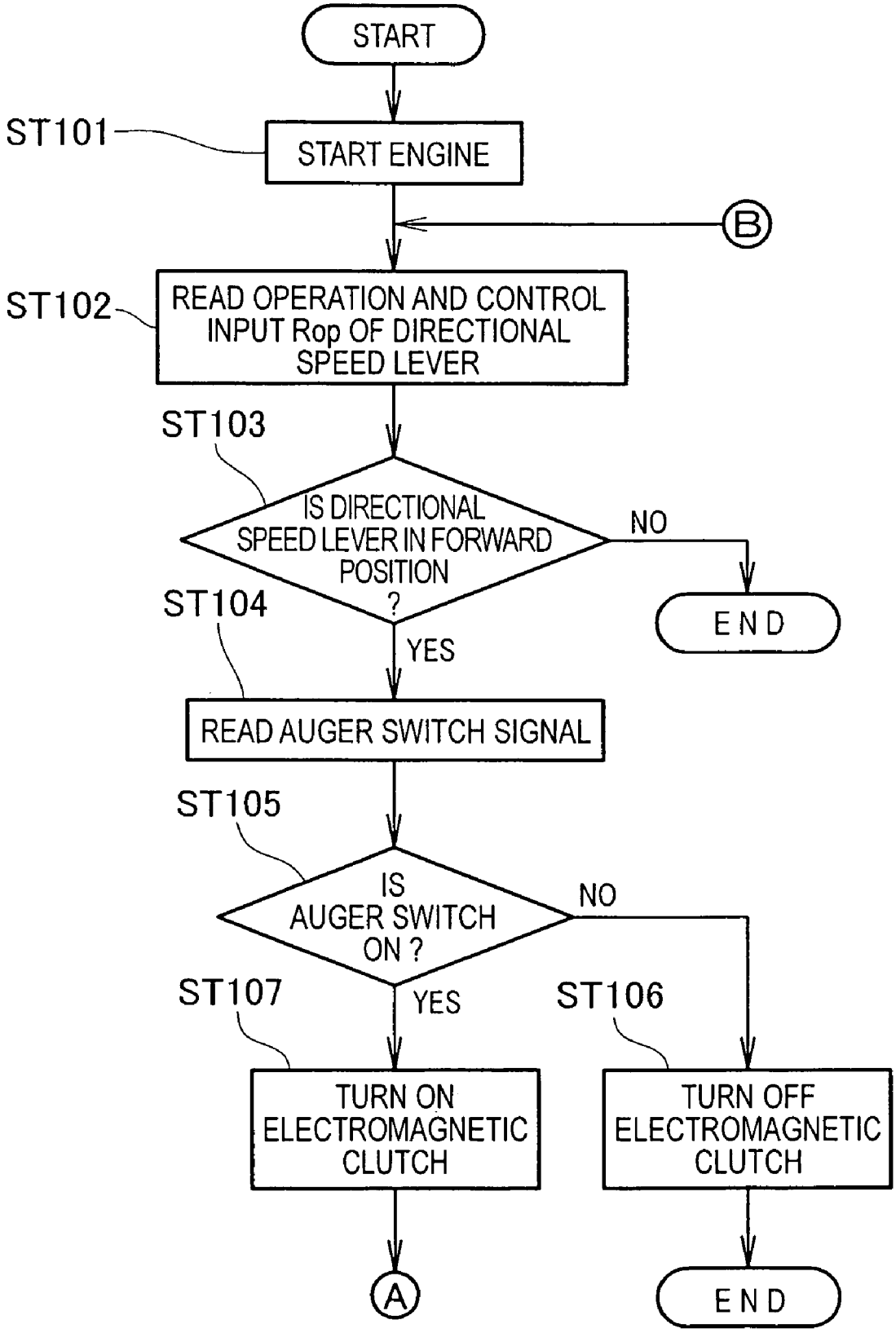
FIG. 8 is a control flowchart showing the first half in the control routine of the second embodiment of the control unit shown in FIG. 2.

A second embodiment of the control routine will next be described with reference to FIGS. 8 and 9.

ST101: The engine 14 is started by turning on the main switch 44.

ST102: The position signal (i.e., the signal indicating the operating position and control input Rop of the directional speed lever 53) of the directional speed lever 53 is read. This position signal is a target speed instruction issued for the electric motors 21L and 21R by the potentiometer 53*a* of the directional speed lever 53.

ST103: It is determined whether the operating position of the directional speed lever 53 is the "forward movement position." If YES, then it is determined that forward travel control will be performed, and the process proceeds to ST104. If NO, then control according to this control routine is ended.

ST104: The switch signal of the auger switch 45 is read.

ST105: It is determined whether the auger switch 45 is ON. If NO, then the process proceeds to ST106. If YES, then the process proceeds to ST107.

ST106: After the electromagnetic clutch 31 is turned OFF, control according to this control routine is ended. As a result, the work unit 13 is stopped or kept in a stopped state.

ST107: After the electromagnetic clutch 31 is turned ON, the process proceeds to ST108 in FIG. 9. As a result, the work unit 13 is actuated by the motive force of the engine 14.

ST108: The travel Cr of the choke valve 73 is measured. The detection signal from the choke position sensor 76 may be read for the travel Cr.

ST109: It is determined whether auto-choke is in effect. If YES, then the process proceeds to ST110. If NO, then the process proceeds to ST118. When the travel Cr of the choke valve 73 is less than 100% (fully closed or partway open state), the determination is YES since warm-up is being performed in which the choke valve 73 is automatically opened and closed according to the temperature state of the engine 14. When the travel Cr is 100% (fully open state), the determination is NO since the warm-up operation is completed.

ST110: The auto-choke display lamp 78 is lit to provide notification that auto-choke is in effect.

ST111: The travel Str of the throttle valve 71 is measured. The detection signal from the throttle position sensor 75 may be read for the travel Str.

ST112: A startup-time correction map Mp1 (see FIG. 10) is selected from among a plurality of correction maps, each of which has different correction characteristics. Details of the startup-time correction map Mp1 will be described hereinafter.

ST113: The deceleration correction coefficient Rd of the electric motors 21L and 21R for the current travel Str of the throttle valve 71 is calculated based on the startup-time correction map Mp1.

ST114: The target speed Ts (target rotational speed Ts) of the electric motors 21L and 21R is calculated based on the amount Rop that the directional speed lever 53 is moved.

ST115: The target speed Ts is corrected according to the deceleration correction coefficient Rd. Specifically, the deceleration correction coefficient Rd calculated in ST113 is multiplied by the target speed Ts calculated in ST114 to make a correction, and the corrected value is designated as a new target speed Ts (Ts=Ts×Rd).

ST116: The actual speed Tr (actual rotational speed Tr; hereinafter referred to as "actual speed Tr") of the electric motors 21L and 21R is measured. The detection signal from the motor rotation sensors 83L and 83R, for example, may be read for the actual speed Tr.

ST117: The electric motors 21L and 21R are controlled so as to rotate forward at the corrected target speed Ts (the value Ts corrected in ST115), after which the process returns to ST102 in FIG. 8. Specifically, forward motion (forward rotation) of the electric motors 21L and 21R is controlled by PID control so that the actual speed Tr of the electric motors 21L and 21R conforms to the corrected target speed Ts. As a result, the travel units 11L and 11R are moved forward or kept in a state of forward motion.

ST118: The auto-choke display lamp 78 is turned off to provide notification that auto-choke is completed.

ST119: The travel Str of the throttle valve 71 is measured.

ST120: A normal-time correction map Mp2 (see FIG. 11) is selected from among a plurality of correction maps, each of which has different correction characteristics. Details of the normal-time correction map Mp2 will be described hereinafter.

ST121: The deceleration correction coefficient Rd of the electric motors 21L and 21R for the current travel Str of the throttle valve 71 is calculated based on the normal-time correction map Mp2.

ST122: The target speed Ts of the electric motors 21L and 21R is calculated based on the amount Rop that the directional speed lever 53 is moved.

ST123: The target speed Ts is corrected according to the deceleration correction coefficient Rd. Specifically, the deceleration correction coefficient Rd calculated in ST121 is multiplied by the target speed Ts calculated in ST122 to make a correction, and the corrected value is designated as a new target speed Ts (Ts=Ts×Rd).

ST124: The actual speed Tr of the electric motors 21L and 21R is measured.

ST125: The electric motors 21L and 21R are controlled so as to rotate forward at the corrected target speed Ts (value Ts corrected in ST123), after which the process returns to ST102 in FIG. 8. Specifically, forward motion control of the electric motors 21L and 21R is executed by PID control so that the actual speed Tr of the electric motors 21L and 21R conforms to the corrected target speed Ts. As a result, the travel units 11L and 11R are moved forward or kept in a state of forward motion.

In the steps shown in FIG. 9, the series from ST111 to ST113 constitutes a first step, ST115 constitutes a second step, and ST117 constitutes a third step.

The control unit 61 executes the first step, the second step, and the third step when the startup condition is satisfied (ST109).

The first step is a routine for calculating the deceleration correction coefficient Rd of the electric motors 21L and 21R for the current travel Str of the throttle valve 71 on the basis of the startup-time correction map Mp1, which is the map that is used during startup of the engine 14 and has characteristics whereby the deceleration correction coefficient Rd of the electric motors 21L and 21R decreases according to an increase in the travel Str of the throttle valve 71, and the deceleration correction coefficient Rd is kept greater than zero in the fully open position.

The second step is a routine for multiplying the deceleration correction coefficient Rd by the target speed Ts to make a correction.

The third step is a routine for controlling the actual speed Tr of the electric motors 21L and 21R so as to conform to the corrected target speed Ts.

The startup-time correction map Mp1 selected in ST112 will be described herein with reference to FIG. 10. The normal-time correction map Mp2 selected in ST120 will also be described with reference to FIG. 11.

Figure 10:
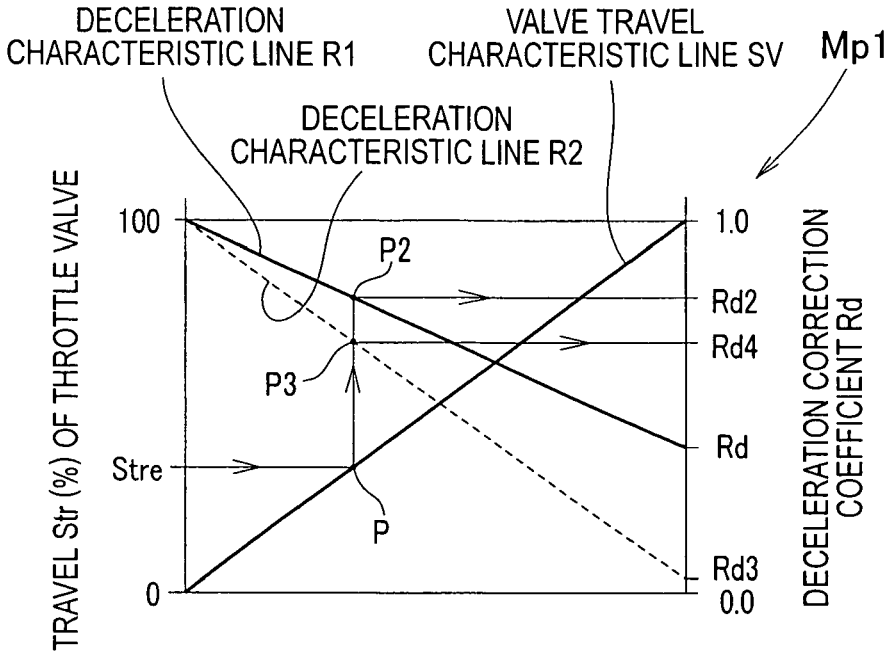
FIG. 10 is a diagram of the startup-time correction map shown in FIG. 9.

FIG. 10 shows the startup-time correction map Mp1 for obtaining the deceleration correction coefficient Rd that corresponds to the travel Str of the throttle valve, wherein the travel Str (%) of the throttle valve is plotted on the vertical axis on the left side of the diagram, and the deceleration correction coefficient Rd of the electric motors is plotted on the vertical axis on the right side of the diagram. The travel Str is scaled with 0% at the bottom and 100% at the top. The deceleration correction coefficient Rd is scaled with 0.0 at the bottom and 1.0 at the top.

The solid line sloping upward and to the right in the diagram is the valve travel characteristic line SV, and is a straight line indicating the change in the travel Str of the throttle valve in the range of 0 to 100%. The solid line sloping downward and to the right in the diagram is the deceleration characteristic line R1, and is a straight line indicating the change in the deceleration correction coefficient Rd of the electric motors in the range of 1.0 to Rd1. The minimum value of the deceleration correction coefficient Rd is Rd1 greater than zero. The maximum value of the deceleration correction coefficient Rd is 1.0.

FIG. 10 will now be analyzed. For example, when the travel Str is the value Stre, the horizontal line passing through Stre intersects with the valve travel characteristic line SV at point P1. The vertical line passing through this intersection point P1 intersects with the deceleration characteristic line R1 at point P2. The horizontal line passing through this intersection point P2 indicates the value Rd2 of the deceleration correction coefficient Rd. In other words, the value of the deceleration correction coefficient corresponding to the travel Stre is Rd2. In the same manner, Rd=1.0 when Str=0%. Rd=Rd1 when Str=100%.

It is apparent from the startup-time correction map Mp1 that the deceleration correction coefficient Rd approaches the value 1 as the travel Str becomes smaller, and approaches the value 0 as the travel Str becomes larger. The startup-time correction map Mp1 thus has characteristics whereby the deceleration correction coefficient Rd of the electric motors decreases according to an increase in the travel Str of the throttle valve, and the deceleration correction coefficient in the fully open position (Str=100%) is Rd1, which is greater than zero. This startup-time correction map Mp1 is a map used during startup of the engine.

Figure 11:
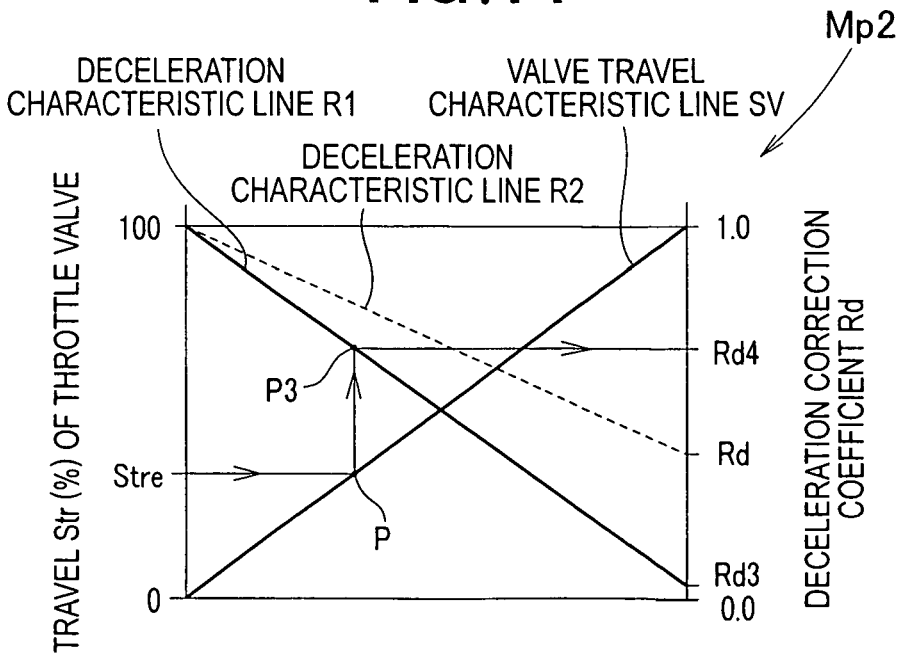
FIG. 11 is a diagram of the normal-time correction map shown in FIG. 9.

FIG. 11 is similar to FIG. 10 described above. Specifically, FIG. 11 shows the normal-time correction map Mp2 for obtaining the deceleration correction coefficient Rd that corresponds to the travel Str of the throttle valve, wherein the travel Str (%) of the throttle valve is plotted on the vertical axis on the left side of the diagram, and the deceleration correction coefficient Rd of the electric motors is plotted on the vertical axis on the right side of the diagram. The travel Str is scaled with 0% at the bottom and 100% at the top. The deceleration correction coefficient Rd is scaled with 0.0 at the bottom and 1.0 at the top.

The solid line sloping upward and to the right in the diagram is the valve travel characteristic line SV, and is a straight line indicating the change in the travel Str of the throttle valve in the range of 0 to 100%. The solid line sloping downward and to the right in the diagram is the deceleration characteristic line R2, and is a straight line indicating the change in the deceleration correction coefficient Rd of the electric motors in the range of 1.0 to Rd3. The minimum value of the deceleration correction coefficient Rd is Rd3, which is slightly greater than zero. The maximum value of the deceleration correction coefficient Rd is 1.0.

FIG. 11 will now be analyzed. For example, when the travel Str is the value Stre, the horizontal line passing through Stre intersects with the valve travel characteristic line SV at point P1. The vertical line passing through this intersection point P1 intersects with the deceleration characteristic line R2 at point P3. The horizontal line passing through this intersection point P3 indicates the value Rd4 of the deceleration correction coefficient Rd. In other words, the value of the deceleration correction coefficient corresponding to the travel Stre is Rd4. In the same manner, Rd=1.0 when Str=0%. Rd=Rd3 when Str=100%.

It is apparent from the normal-time correction map Mp2 that the deceleration correction coefficient Rd approaches the value 1 as the travel Str becomes smaller, and approaches the value 0 as the travel Str becomes larger. The normal-time correction map Mp2 thus has characteristics whereby the deceleration correction coefficient Rd of the electric motors decreases according to an increase in the travel Str of the throttle valve, and the deceleration correction coefficient in the fully open position (Str=100%) is Rd3, which is greater than zero. This normal-time correction map Mp2 is a map used after startup of the engine is completed.

FIG. 10 will be considered here in comparison with FIG. 11. The dashed line sloping downward and to the right of the diagram in FIG. 10 is transcribed as the deceleration characteristic line R2 shown in FIG. 11.

As is clear from FIG. 10, the slope of the deceleration characteristic line R1 in the startup-time correction map Mp1 indicated by the solid line is more gradual than that of the deceleration characteristic line R2 in the normal-time correction map Mp2 indicated by the dashed line. The deceleration characteristic line R2 of the normal-time correction map Mp2 has characteristics whereby Rd=Rd3 when Str=100%. Rd3 is the minimum value of the deceleration characteristic line R2, and is a small value extremely close to zero. On the other hand, the deceleration characteristic line R1 of the startup-time correction map Mp1 has characteristics whereby Rd=Rd1 when Str=100%. Rd1 is the minimum value of the deceleration characteristic line R1, and is a relatively larger value in comparison with Rd3 (Rd1>Rd3).

The following is a summary of the description given above. The value of the deceleration correction coefficient Rd when the throttle valve 71 is fully open is Rd3 on the deceleration characteristic line R2 in the normal-time correction map Mp2, whereas this value is Rd1 on the deceleration characteristic line R1 in the startup-time correction map Mp1. These values are also related such that "Rd1>Rd3." In the deceleration characteristic line R1 of the startup-time correction map Mp1, the range of variation of the deceleration correction coefficient Rd is 1.0 to Rd1, and is reduced in proportion to the extent to which Rd1 is greater than Rd3. Therefore, the slope of the deceleration characteristic line R1 of the startup-time correction map Mp1 indicated by the solid line is more gradual than that of the deceleration characteristic line R2 in the normal-time correction map Mp2 indicated by the dashed line. The rate at which the deceleration correction coefficient Rd is reduced according to the increase of the travel Str during startup of the engine 14 can be reduced by an amount commensurate with the degree to which the slope of the deceleration characteristic line R1 is made gradual. For example, the following occurs when Str=Stre. Rd=Rd4 in accordance with the deceleration characteristic line R2 of the normal-time correction map Mp2. In contrast, according to the deceleration characteristic line R1 of the startup-time correction map Mp1, Rd=Rd2 and is larger tan Rd4 (Rd2>Rd4).

The deceleration correction coefficients Rd1 and Rd3 for a fully open throttle valve 71 may be set to the optimum values while taking into account the characteristics of the work machine 10 or the engine 14.

The operation of a work machine 10 provided with a control unit 61 having the control routine of the second embodiment will next be described with reference to FIGS. 2 and 8 through 12.

Figure 12:
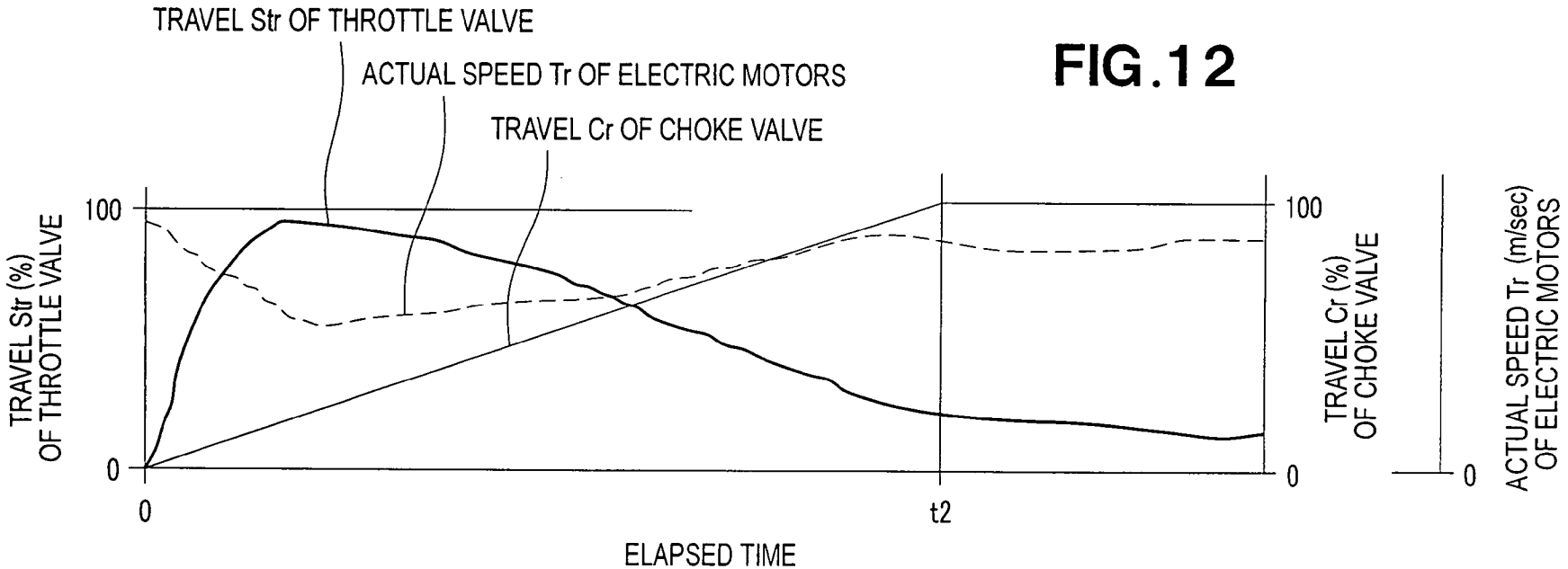
FIG. 12 is a diagram describing the characteristics of the self-propelled work machine on the basis of the control routine of the second embodiment shown in FIGS. 8 and 9.

FIG. 12 shows the performance of the work machine, wherein elapsed time is plotted on the horizontal axis, the travel Str (%) of the throttle valve is plotted on the left vertical axis, and the travel Cr (%) of the choke valve and the actual speed Tr (m/sec) of the electric motors are plotted on the right vertical axis.

The travel Cr of the choke valve 73 is 0% at t1 and 100% at t2, where t1 is the time at which the engine 14 is started, and t2 is the time at which the warm-up operation is completed. In other words, the travel Cr of the choke valve 73 gradually increases from 0% to 100% according to the warm-up state.

The load placed on the engine 14 is large when the work unit 13 is driven by the engine 14 (YES in ST105) while the travel units 11L and 11R are moved forward by the electric motors 21L and 21R (YES in ST103) at substantially the same time as the engine 14 is started (ST101). Therefore, the travel Str of the throttle valve 71 suddenly increases. In other words, the travel Str of the throttle valve 71 becomes unnecessarily large, as shown in FIG. 12.

In contrast, during auto-choke (YES in S109) from time t1 to time t2, i.e., during the warm-up operation, the control unit 61 calculates (ST113) the deceleration correction coefficient Rd of the electric motors 21L and 21R in correspondence to the travel Str of the throttle valve 71 at any given time using the startup-time correction map Mp1 (ST112) shown in FIG. 10. The control unit 61 also controls (ST117) the actual speed Tr of the electric motors 21L and 21R on the basis of the target speed Ts corrected using the deceleration correction coefficient Rd (ST115). The actual speed Tr of the electric motors 21L and 21R therefore never reaches the minimum even when the throttle valve 71 is fully open. The deceleration correction coefficient Rd in the fully open position is set to a value Rd1, which is greater than zero. In other words, as shown in FIG. 10, the slope of the deceleration characteristic line R1 of the startup-time correction map Mp1 is relatively gradual. The rate at which the deceleration correction coefficient Rd is reduced according to the increase in the travel Str of the throttle valve 71 can be reduced by a commensurate amount. Therefore, the actual speed Tr of the electric motors 21L and 21R decreases relatively gradually regardless of a sudden increase in the travel Str of the throttle valve 71, as shown in FIG. 12.

Furthermore, the deceleration correction coefficient Rd at any given time is calculated from the startup-time correction map Mp1. Therefore, the deceleration correction coefficient Rd can be calculated extremely rapidly, and the actual speed Tr of the electric motors 21L and 21R can be controlled more rapidly based on the target speed Ts corrected by this deceleration correction coefficient Rd. Accordingly, the responsiveness (response) of the speed variation of the electric motors 21L and 21R in relation to the load placed on the engine 14 is good during engine startup. The snow removing properties of the work machine 10 can therefore be even further enhanced.

The engine 14 is in the normal operating state after time t2 (NO in ST109) when auto-choke (the warm-up operation) is completed. The control unit 61 calculates (ST121) the deceleration correction coefficient Rd of the electric motors 21L and 21R in correspondence to the travel Str of the throttle valve 71 at any given time by using the normal-time correction map Mp2 (ST12) shown in FIG. 11. The control unit 61 also controls (ST125) the actual speed Tr of the electric motors 21L and 21R on the basis of the target speed Ts corrected by the deceleration correction coefficient Rd (ST123).

A modified example of the second embodiment of the control routine will next be described with reference to FIGS. 13 and 14.

Figure 13:
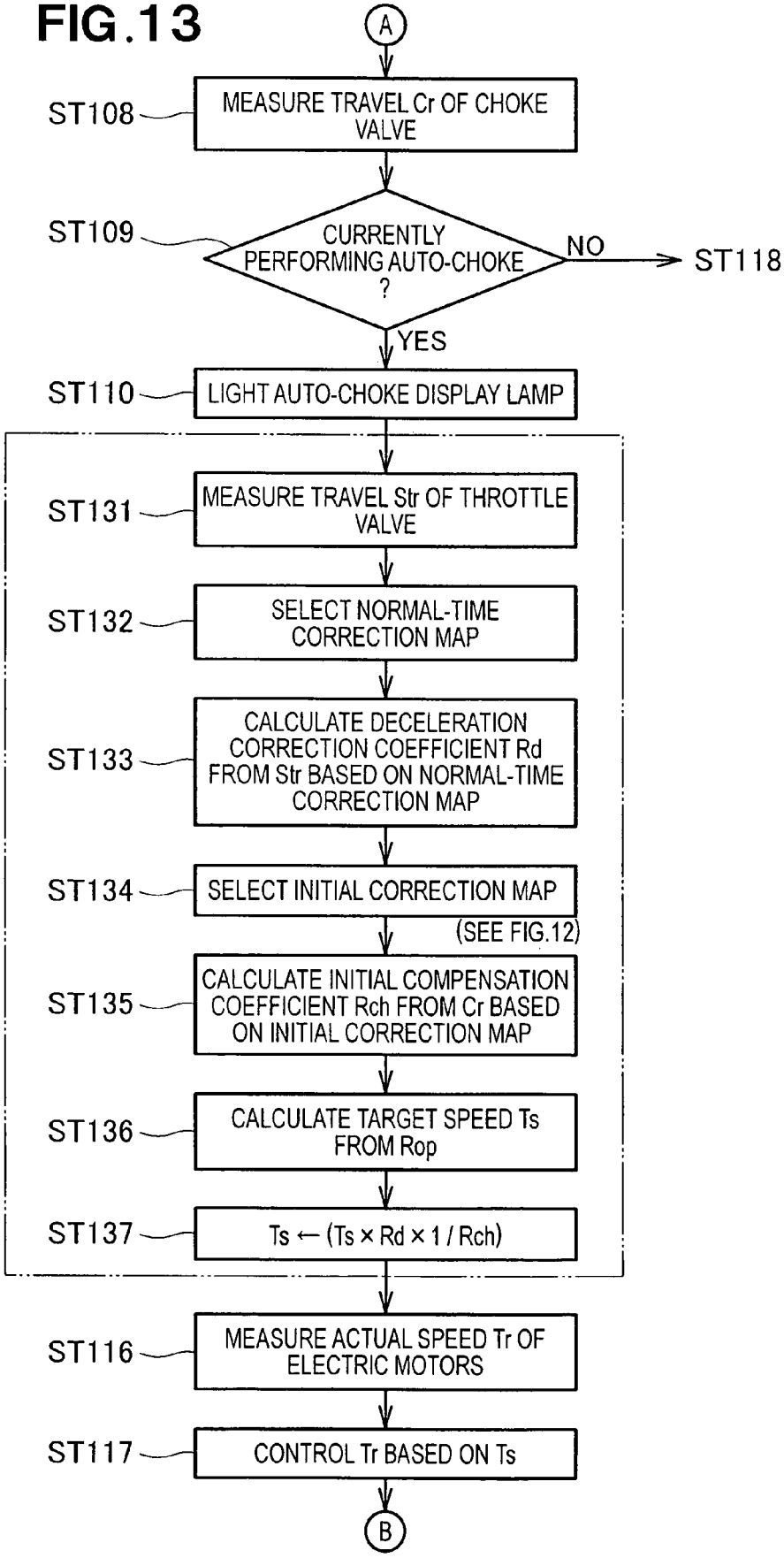
FIG. 13 is a diagram of a modified example of the control flowchart of the second embodiment shown in FIG. 9.

An essential feature of the control routine according to this modified example is that the configuration (configuration enclosed in the frame of imaginary lines) of ST111 through ST115 in FIG. 9 described above is changed to the configuration (configuration enclosed in the frame of imaginary lines) of ST131 through ST137 shown in FIG. 13. Other aspects thereof are the same as in the previously described second embodiment, and description thereof is omitted.

FIG. 13 is a control flowchart of a modified example of the control unit according to the present invention.

ST108: The travel Cr of the choke valve 73 is measured.

ST109: It is determined whether auto-choke is in effect. If YES, then the process proceeds to ST110. If NO, then the process proceeds to ST118 (see FIG. 9).

ST110: After the auto-choke display lamp 78 is lit, the process proceeds to ST131.

ST131: The travel Str of the throttle valve 71 is measured.

ST132: A normal-time correction map Mp2 (see FIG. 11) is selected from among a plurality of correction maps, each of which has different correction characteristics.

ST133: The deceleration correction coefficient Rd of the electric motors 21L and 21R for the current travel Str of the throttle valve 71 is calculated based on the normal-time correction map Mp2.

ST134: An initial correction map Mp3 (see FIG. 14) is selected from among a plurality of correction maps, each of which has different correction characteristics. The details of the initial correction map Mp3 are described hereinafter.

ST135: The initial correction coefficient Rch of the electric motors 21L and 21R for the current travel Cr of the choke valve 73 is calculated based on the initial correction map Mp3.

ST136: The target speed Ts of the electric motors 21L and 21R is calculated based on the control input Rop of the directional speed lever 53.

ST137: After the target speed Ts is corrected according to the deceleration correction coefficient Rd and the initial correction coefficient Rch, the process proceeds to ST116. Specifically, the original target speed Ts calculated from the control input Rop of the directional speed lever 53 is multiplied by the deceleration correction coefficient Rd and the inverse of the initial correction coefficient Rch to make a correction, and the corrected value is designated as a new target speed Ts ($Ts=Ts\times Rd\times 1/Rch$).

ST116: The actual speed Tr of the electric motors 21L and 21R is measured.

ST117: Forward motion (forward rotation) of the electric motors 21L and 21R is controlled by PID control so that the actual speed Tr of the electric motors 21L and 21R conforms to the corrected target speed Ts, after which the process returns to ST102. The travel units 11L and 11R are moved forward.

In the modified steps shown in FIG. 13, the series including ST108, ST134, and ST135 constitutes a first step. The series from ST131 to ST133 constitutes a second step. ST137 constitutes a third step, and ST117 constitutes a fourth step.

The control unit 61 according to this modified example executes the first step, the second step, the third step, and the fourth step when the startup condition is satisfied (ST109).

The first step is a routine for calculating the initial correction coefficient Rch of the electric motors 21L and 21R for the current travel Cr of the choke valve 73 on the basis of the initial correction map Mp3 (see FIG. 14), which is the map used during startup of the engine 14 and has characteristics whereby the initial correction coefficient Rch of the electric motors 21L and 21R increases according to an increase in the travel Cr of the choke valve 73.

The second step is a routine for calculating the deceleration correction coefficient Rd of the electric motors 21L and 21R for the current travel Str of the throttle valve 71 on the basis of the normal-time correction map Mp2 (see FIG. 11), which is the map used after startup of the engine 14 is completed, and which has characteristics whereby the deceleration correction coefficient Rd of the electric motors 21L and 21R decreases according to an increase in the travel Str of the throttle valve 71.

The third step is a routine for multiplying the target speed Ts by the deceleration correction coefficient Rd and the inverse of the initial correction coefficient Rch to make a correction.

The fourth step is a routine for controlling the actual speed Tr of the electric motors 21L and 21R in accordance with the corrected target speed Ts.

The initial correction map Mp3 selected in ST134 will be described herein with reference to FIG. 14.

Figure 14:
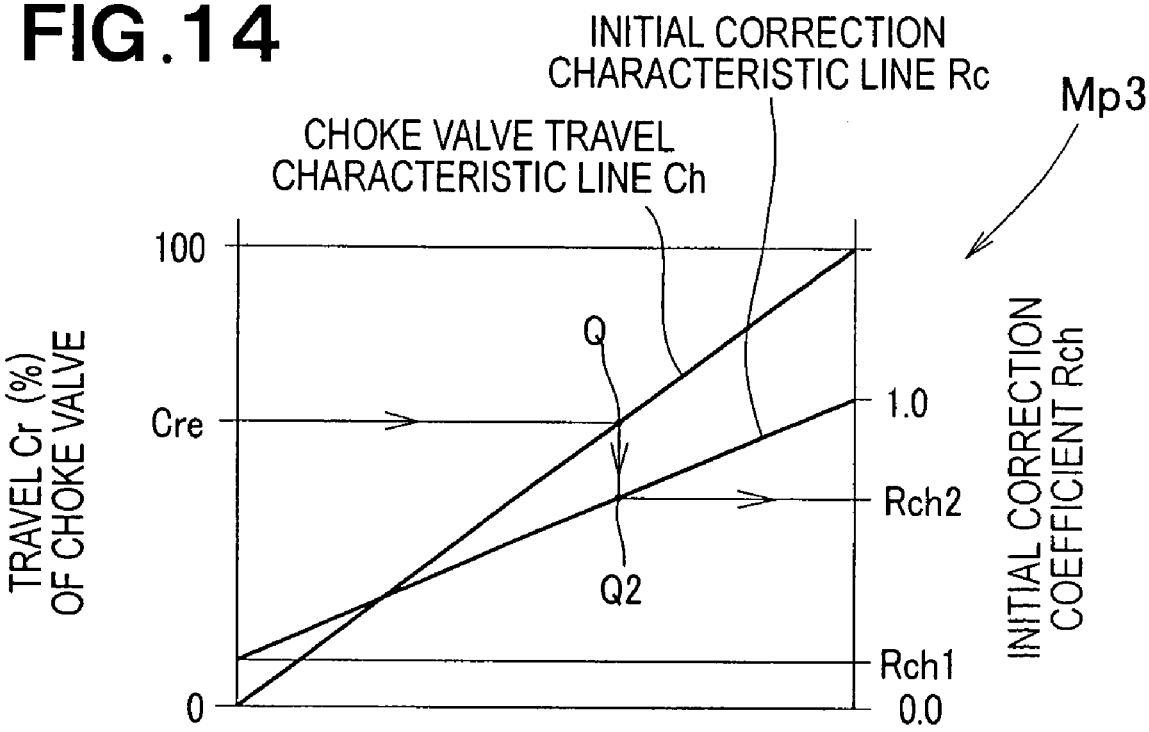
FIG. 14 is a diagram of the initial correction map shown in FIG. 13.

FIG. 14 shows the initial correction map Mp3 for obtaining the initial correction coefficient Rch that corresponds to the travel Cr of the choke valve, wherein the travel Cr (%) of the choke valve is plotted on the left vertical axis of the diagram, and the initial correction coefficient Rch of the electric motors is plotted on the right vertical axis of the diagram. The travel Cr is scaled with 0% at the bottom and 100% at the top. The initial correction coefficient Rch is scaled with 0.0 at the bottom and 1.0 at the top.

The solid line sloping upward and to the right in the diagram is the choke valve travel characteristic line Ch, and is a straight line indicating the change in the travel Cr of the choke valve in the range of 0 to 100%. The dashed line sloping upward and to the right in the diagram is the initial correction characteristic line Rc, and is a straight line indicating the change in the initial correction coefficient Rch of the electric motors in the range of Rch1 to 1.0. Rch1, which is the minimum value of the initial correction coefficient Rch, is slightly greater than zero. The maximum value of the initial correction coefficient Rch is 1.0.

This diagram will now be analyzed. For example, when the travel Cr is the value Cre, the horizontal line passing through Cre intersects with the choke valve travel characteristic line Ch at point Q1. The vertical line passing through this intersection point Q1 intersects with the initial correction characteristic line Rc at point Q2. The horizontal line passing through this intersection point Q2 indicates the value Rch2 of the initial correction coefficient Rch. In other words, the value of the initial correction coefficient Rch corresponding to the travel Cre is Rch2. In the same manner, Rch=Rch1 when Cr=0%. Rch=1.0 when Cr=100%.

It is apparent from the initial correction map Mp3 that the initial correction coefficient Rch is a value near 0 as long as the travel Cr is small, and is a value near 1 as long as the travel Cr is large. The initial correction map Mp3 thus has characteristics whereby the initial correction coefficient Rch of the electric motors increases according to an increase in the travel Cr of the choke valve, and the initial correction coefficient Rch in the fully closed position (Cr=0%) is Rch1 greater than zero. The initial correction map Mp3 is a map used during startup of the engine 14.

As is clear from the description given above, a normal-time correction map Mp2 (see FIG. 11) and an initial correction map Mp3 (see FIG. 14) are prepared in advance in this modified example. The control unit 61 in this modified example calculates (ST133) the deceleration correction coefficient Rd during startup (YES in ST109) of the engine 14, calculates (ST135) the initial correction coefficient Rch, corrects (ST137) the target speed Ts according to the deceleration correction coefficient Rd and the inverse of the initial correction coefficient Rch, and controls (ST117) the speed of the electric motors 21L and 21R on the basis of the corrected target speed Ts. As a result, the target speed Ts can be corrected extremely rapidly. The actual speed Tr of the electric motors 21L and 21R can also be controlled more rapidly.

Specifically, the travel Cr of the choke valve 73 gradually becomes larger in accordance with the warm-up state during startup of the engine 14, as shown in FIG. 12. The load placed on the engine 14 is large in a case in which the work unit 13 is driven by the engine 14 while the travel units 11L and 11R are advanced by the electric motors 21L and 21R at substantially the same time as the engine 14 is started. The travel Str of the throttle valve 71 therefore suddenly increases.

Specifically, when snow is removed at substantially the same time as the engine 14 is started, the travel Cr of the choke valve 73 is small, and the travel Str of the throttle valve 71 is large in this state, in which there is almost no warm-up. As warm-up progresses, the travel Cr of the choke valve 73 increases, and the travel Str of the throttle valve 71 decreases.

In view of this, the target speed Ts of the electric motors 21L and 21R is multiplied not only by the deceleration correction coefficient Rd, but also by the inverse of the initial correction coefficient Rch to make a correction according to the modified example. The actual speed Tr of the electric motors 21L and 21R can thereby be more precisely and rapidly controlled. Accordingly, the responsiveness (response) of the speed variation of the electric motors 21L and 21R in relation to the load placed on the engine 14 is good during engine startup. The snow removing properties of the work machine 10 can therefore be even further enhanced. In other words, the same operations and effects are demonstrated as in the first embodiment shown in FIG. 6 described above.

As described above, the following effects are demonstrated by the control routine of the second embodiment (including the modified example of the second embodiment) in the control unit 61.

The control unit 61 performs control so as to reduce the actual speed Tr of the electric motors 21L and 21R in relation to an increase in the travel Str of the throttle valve 71. The control unit 61 also performs control so that the rate at which the actual speed Tr is reduced relative to an increase in the travel Str is further reduced when the startup condition of the engine 14 is satisfied (YES in ST109 of FIG. 9) than when this condition is not satisfied. The startup condition is that the choke valve 73 is being adjusted by the electronic governor 65, i.e., a condition wherein the engine 14 is warming up.

According to the second embodiment thus configured, in the engine startup state in which the choke valve 73 is driven, control can be performed so that the rate at which the travel speed of the work machine 10 is reduced relative to an increase in the travel Str of the throttle valve 71 decreases in comparison with the time after startup is completed.

The travel Str of the throttle valve 71 suddenly increases since the load placed on the engine 14 is large when the work unit 13 is driven by the engine 14 while the travel units 11L and 11R are moved forward by the electric motors 21L and 21R at substantially the same time as the engine 14 is started.

In contrast, a configuration is adopted in the second embodiment whereby the actual speed Tr is reduced relatively gradually regardless of a sudden increase in the travel Str. The travel speed of the work machine 10 can therefore also be reduced relatively smoothly. As a result, snow can be removed by the work unit 13 more rapidly. Since the snow removal capability of the engine 14 during warm-up can thus be increased, the snow removal capability of the work machine 10 can be further increased.

The control unit 61 also performs control so as to bring the rate at which the travel speed is reduced relative to an increase in the travel Str of the throttle valve 71 to a lower level than when the choke valve 73 is stopped. This is performed only when three conditions are satisfied. These conditions include a condition (ST103 of FIG. 8) wherein the travel units 11L and 11R are moving forward, a condition (ST105 of FIG. 8) wherein the work unit 13 is removing snow, and a condition (ST109 of FIG. 8) wherein the startup condition is satisfied.

The second embodiment is thus configured so that the rate at which the travel speed is reduced relative to an increase in the travel Str of the throttle valve 71 decreases only when snow is being removed by the work unit 13 (i.e., during snow removal) while the work machine 10 is traveling forward in the engine startup state in which the choke valve 73 is driven.

When snow is not being removed, the work machine 10 is merely traveling, and the engine 14 is therefore not subjected to a load associated with snow removal. Since the travel speed can be freely set regardless of the state of the engine 14 in the second embodiment, the mobility of the work machine 10 is enhanced.

Figure 15:
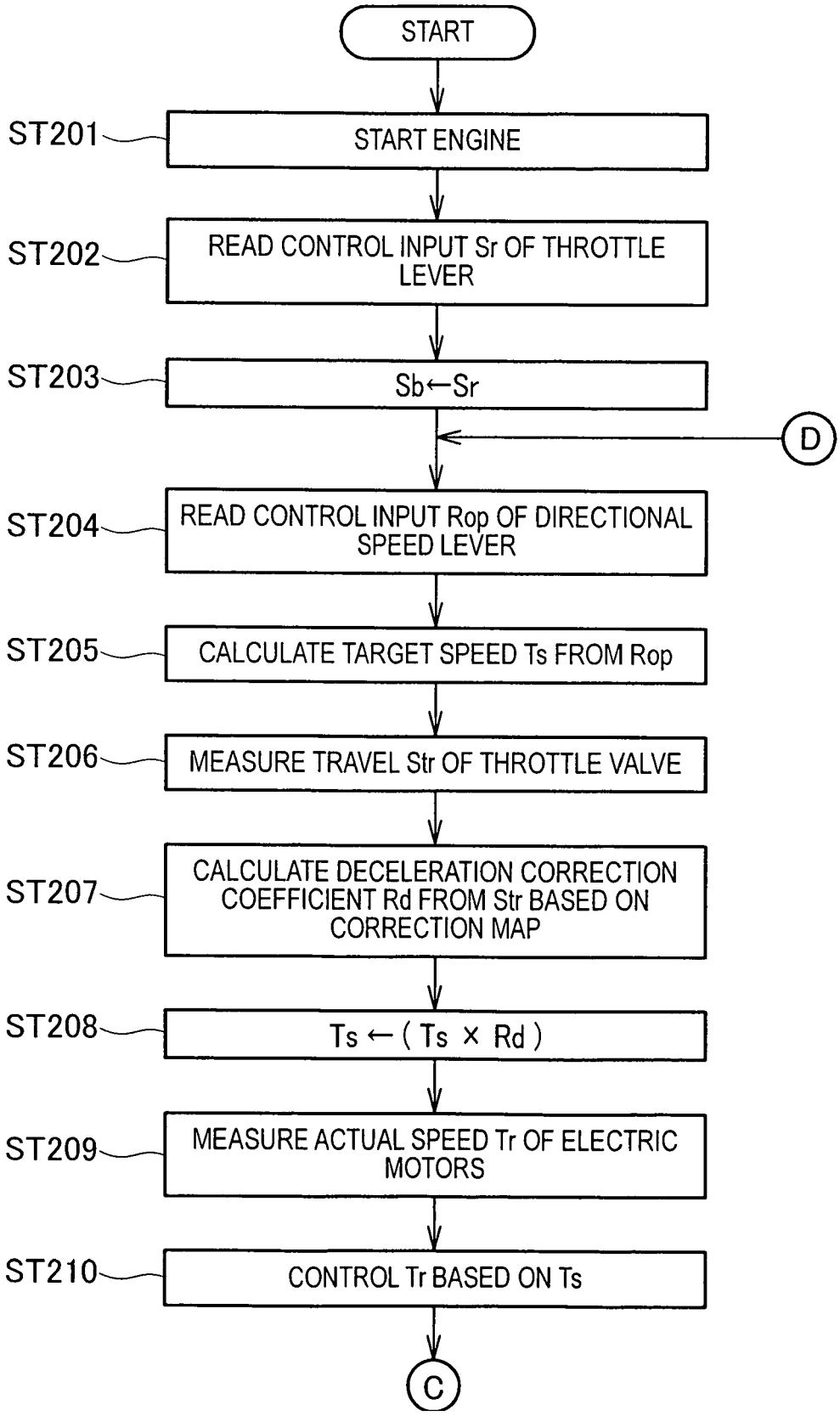
FIG. 15 is a control flowchart showing the first half in the control routine of the third embodiment of the control unit shown in FIG. 2.
Figure 16:
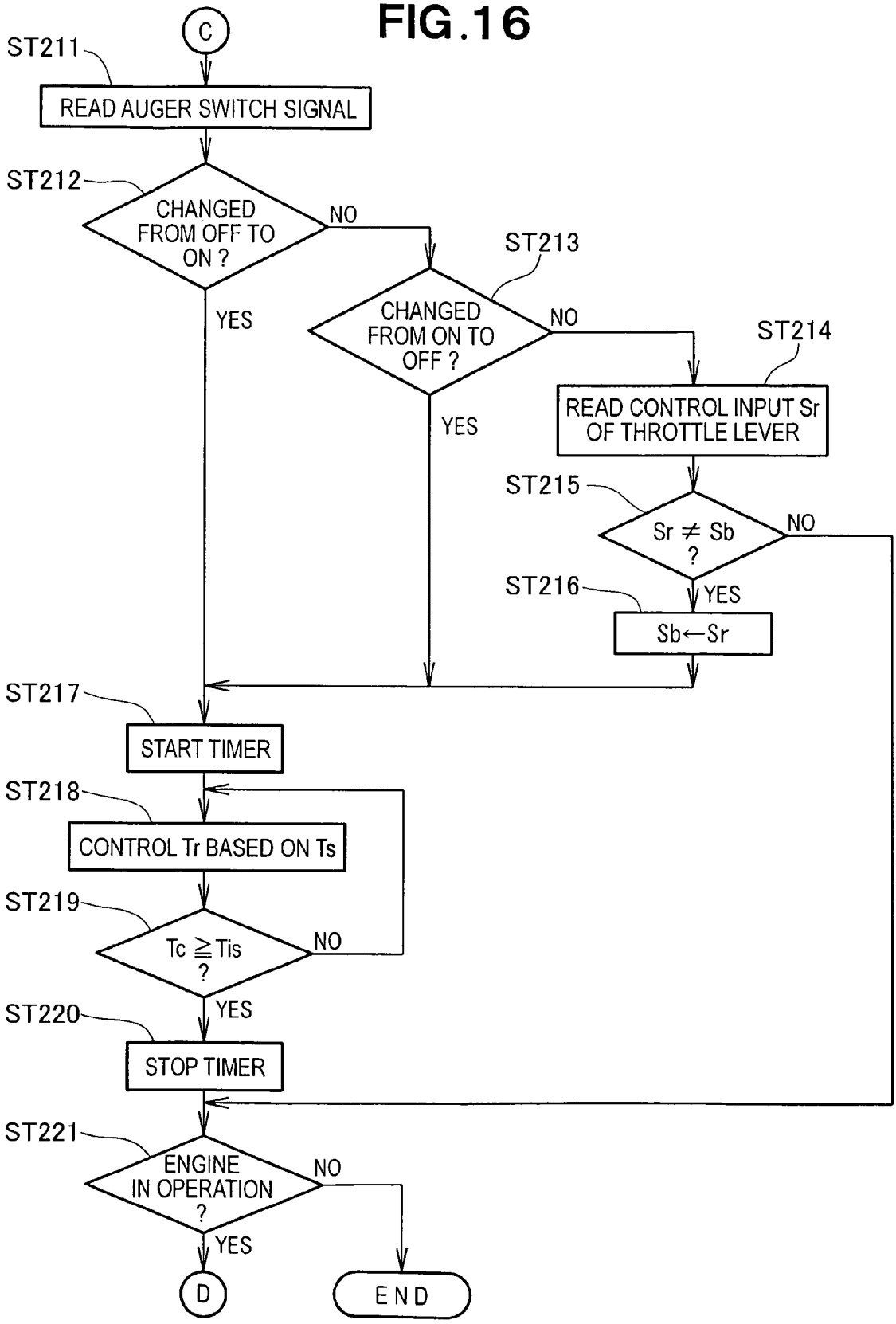
FIG. 16 is a control flowchart showing the second half in the control routine of the third embodiment of the control unit shown in FIG. 2.

A third embodiment of the control routine will next be described with reference to FIGS. 15 and 16. A case will be described in the third embodiment in which the operating position of the directional speed lever 53 is the "forward position."

ST201: The engine 14 is started by turning on the main switch 44.

ST202: The control input Sr of the throttle lever 52 is read. The signal indicating the amount of movement issued by the potentiometer 52*a* in accordance with the position of the throttle lever 52 may be read as the control input Sr.

ST203: The control input Sr read in ST202 is considered to be the initial value of the "old movement amount Sb," and is temporarily stored (written into memory 63).

ST204: The position signal (i.e., the signal indicating the operating position and control input Rop of the directional speed lever 53) of the directional speed lever 53 is read. This position signal is a target speed instruction issued for the electric motors 21L and 21R by the potentiometer 53*a* of the directional speed lever 53.

ST205: The target speed Ts of the electric motors 21L and 21R is calculated based on the control input Rop of the directional speed lever 53.

ST206: The travel Str of the throttle valve 71 is measured.

ST207: The deceleration correction coefficient Rd of the electric motors 21L and 21R for the current travel Str of the throttle valve 71 is calculated based on a correction map. The "normal-time correction map Mp2" shown in FIG. 11 is used without modification as the "correction map." In other words, the deceleration correction coefficient Rd in relation to the travel Str is calculated according to the deceleration characteristic line R2 and valve travel characteristic line SV shown in FIG. 11.

ST208: The target speed Ts is corrected according to the deceleration correction coefficient Rd. Specifically, the target speed Ts calculated in ST205 is multiplied by the deceleration correction coefficient Rd calculated in ST207 to make a correction, and the corrected value is designated as a new target speed Ts (Ts=Ts×Rd).

ST209: The actual speed Tr of the electric motors 21L and 21R is measured.

ST210: The electric motors 21L and 21R are controlled so as to rotate forward at the corrected target speed Ts (value Ts corrected in ST208), after which the process proceeds to ST211 in FIG. 16. Specifically, forward motion (forward rotation) of the electric motors 21L and 21R is controlled by PID control so that the actual speed Tr of the electric motors 21L and 21R conforms to the corrected target speed Ts. As a result, the travel units 11L and 11R are moved forward or kept in a state of forward motion.

The variation of the travel Str of the throttle valve 71 is thus continually measured, and the actual speed Tr of the electric motors 21L and 21R is controlled while the target speed Ts is corrected according to the travel Str. The travel speed of the travel units 11L and 11R can thereby be controlled.

ST211: The switch signal of the auger switch 45 is read.

ST212: It is determined whether the auger switch 45 has changed from OFF to ON (OFF to ON). If NO, then the process proceeds to ST213. If YES, then the process proceeds to ST217. When the operator switches the auger switch 45 to ON, the switch signal issued by this auger switch 45 changes from OFF to ON. When the switch signal reverses, the control unit 61 determines that an instruction to operate the work unit 13 on the basis of the action of the operator" has been received, and a YES condition is established. In other words, the control unit 61 receives an instruction to operate the work unit 13 on the basis of an action only when the switch is ON. Although not shown in the drawing, the electromagnetic clutch 31 turns ON in the case of a YES condition. Operation of the work unit 13 is started as a result.

ST213: It is determined whether the auger switch 45 has changed from ON to OFF (ON to OFF). If NO, then the process proceeds to ST214. If YES, then the process proceeds to ST217. When the operator switches the auger switch 45 OFF, the switch signal issued by this auger switch 45 changes from ON to OFF. When the switch signal reverses, the control unit 61 determines that an instruction to stop the work unit 13 on the basis of the action of the operator" has been received, and a YES condition is established. In other words, the control unit 61 receives an instruction to stop the work unit 13 on the basis of an action only when the switch is OFF. Although not shown in the drawing, the electromagnetic clutch 31 turns OFF in the case of a YES condition. The work unit 13 is stopped as a result.

ST214: The control input Sr of the throttle lever 52 is read.

ST215: It is determined whether the control input Sr in ST214 does not match the value of the "old movement amount Sb" stored in the memory 63. If YES, then the process proceeds to ST216. If NO, then the process proceeds to ST221. When there is a new change in the control input Sr in relation to the old movement amount Sb, the control unit 61 determines that the throttle lever 52 has been operated (a command for varying the rotational speed of the engine 14 has been received), and a YES condition is established.

ST216: The control input Sr read in ST214 is temporarily stored as the value of the "old movement amount Sb." In other words, each time a YES condition is established in ST215, the value of the "old movement amount Sb" is written into the memory 63 after being substituted as the value of the new control input Sr.

ST217: After the count time Tc of a timer housed in the control unit 61 is reset (Tc=0), the timer is started.

ST218: The motor control state executed in ST210 is continued. In other words, forward movement control of the electric motors 21L and 21R is performed by PID control so that the actual speed Tr of the electric motors 21L and 21R conforms to the corrected target speed Ts (value Ts corrected in ST208).

ST219: It is determined whether the count time Tc (elapsed time Tc) has passed a preset specific reference time Tis. If NO, then the process returns to ST218. If YES, then the process proceeds to ST220. In other words, ST218 and ST219 are repeated until a YES condition is established. As a result, the electric motors 21L and 21R can be controlled while the control state of ST218 is maintained.

When the same action can be obtained without the use of ST218, ST218 may be omitted. In this case, only ST219 is repeated until a YES condition is established.

ST220: The timer is stopped.

ST221: It is determined whether the engine 14 is in operation. If YES, then the process returns to ST204. If NO, then control according to this control routine is ended. In other words, returning the system to ST204 in the case of a YES outcome causes the state in which the electric motors 21L and 21R are controlled to be continued in conjunction with the operation of the engine 14. For example, the outcome is YES when the rotational speed of the engine 14 measured by the engine rotation sensor 77 exceeds a prescribed reference value (for example, the rotational speed just before the engine 14 stops).

When the outcome is NO in ST215, the control unit 61 determines that there is no temporary instability of the signal issued from the engine 14 to the control unit 61 since the two subsequent instructions are not present. The first instructions are an operating instruction and a stop instruction (ST212 to ST213) issued for the work unit 13 by the operation of the auger switch 45. The second instruction is a rotational speed variation instruction (ST215) issued for the engine 14 by operation of the throttle lever 52.

As is clear from the description given above, the structure composed of the series from ST204 to ST210 described above constitutes a load control unit for controlling the rotation of the electric motors 21L and 21R on the basis of the control input Rop of the directional speed lever 53 and the travel Str of the throttle valve 71. The load control unit continually detects the amount of change in the control input Rop and the travel Str, and controls the travel speed according to the amount of change.

The travel surface on which the work machine 10 travels has irregularities or inclines. Even when the work unit 13 is stopped, resistance to travel occurs according to the road surface conditions in the travel units 11L and 11R during travel. In the control routine of the third embodiment, such travel conditions are considered in order to give the work machine 10 the ability to travel more smoothly.

Therefore, the control unit 61 is configured (ST204 to ST210) so as to control the electric motors 21L and 21R in conjunction with the engine 14 even when the work unit 13 is stopped while the engine 14 is in operation (ST221).

The operation of a work machine 10 provided with a control unit 61 having the control routine of the third embodiment will next be described with reference to FIGS. 17A, 17B, 2, 15, and 16.

Figures 17A, 17B:
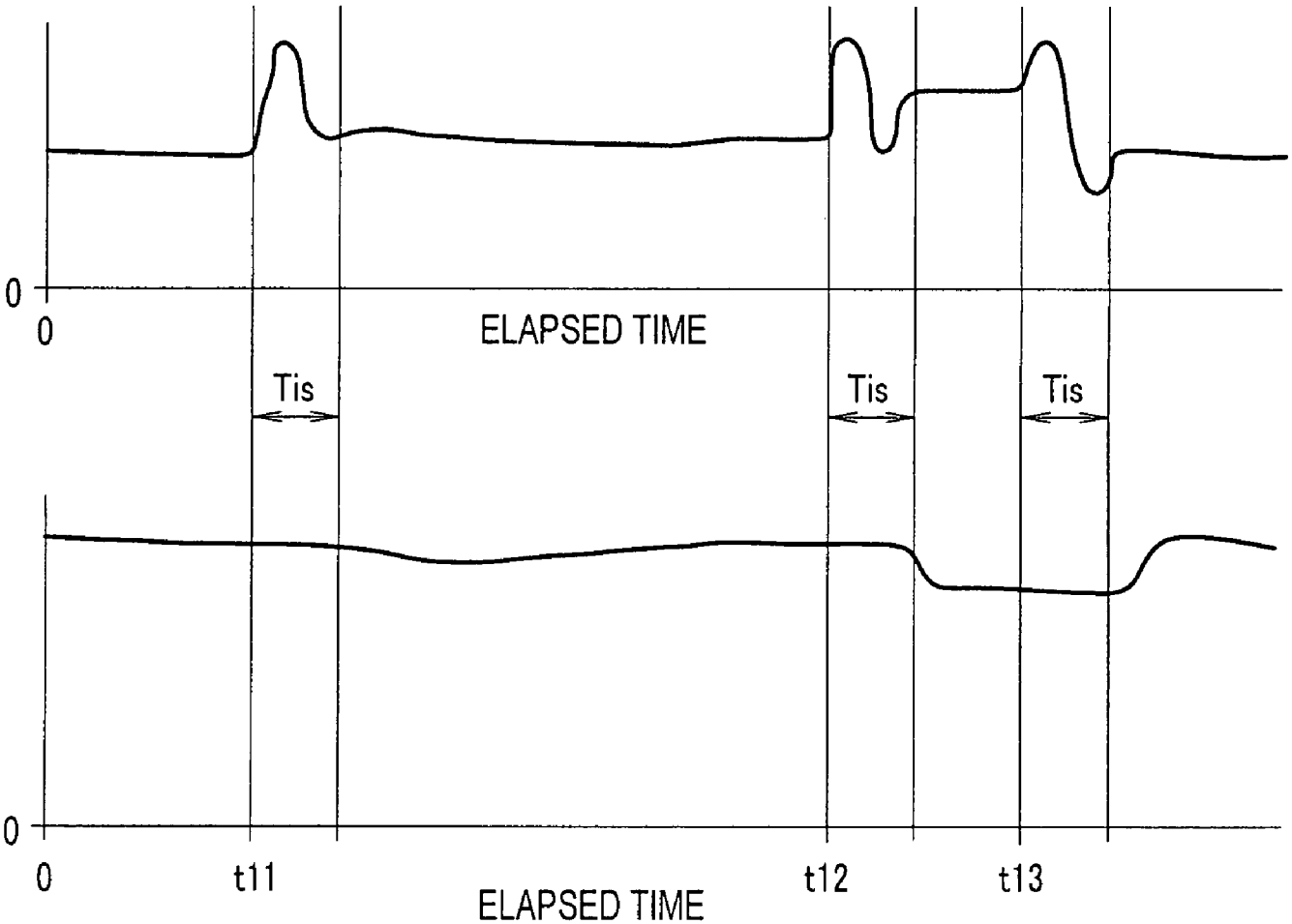
FIGS. 17A and 17B are diagrams describing the characteristics of the self-propelled work machine on the basis of the control routine of the third embodiment shown in FIGS. 15 and 16.
Figure 18A:
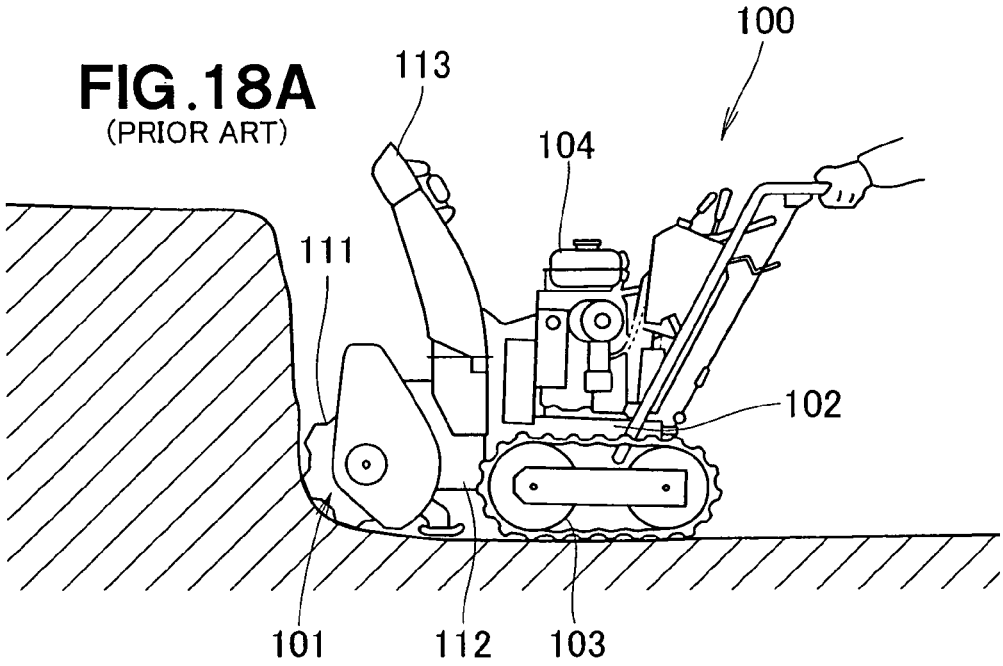
FIG.18A (PRIOR ART)
FIGS. 18A and 18B are simplified diagrams of the conventional self-propelled work machine.
Figure 18B:
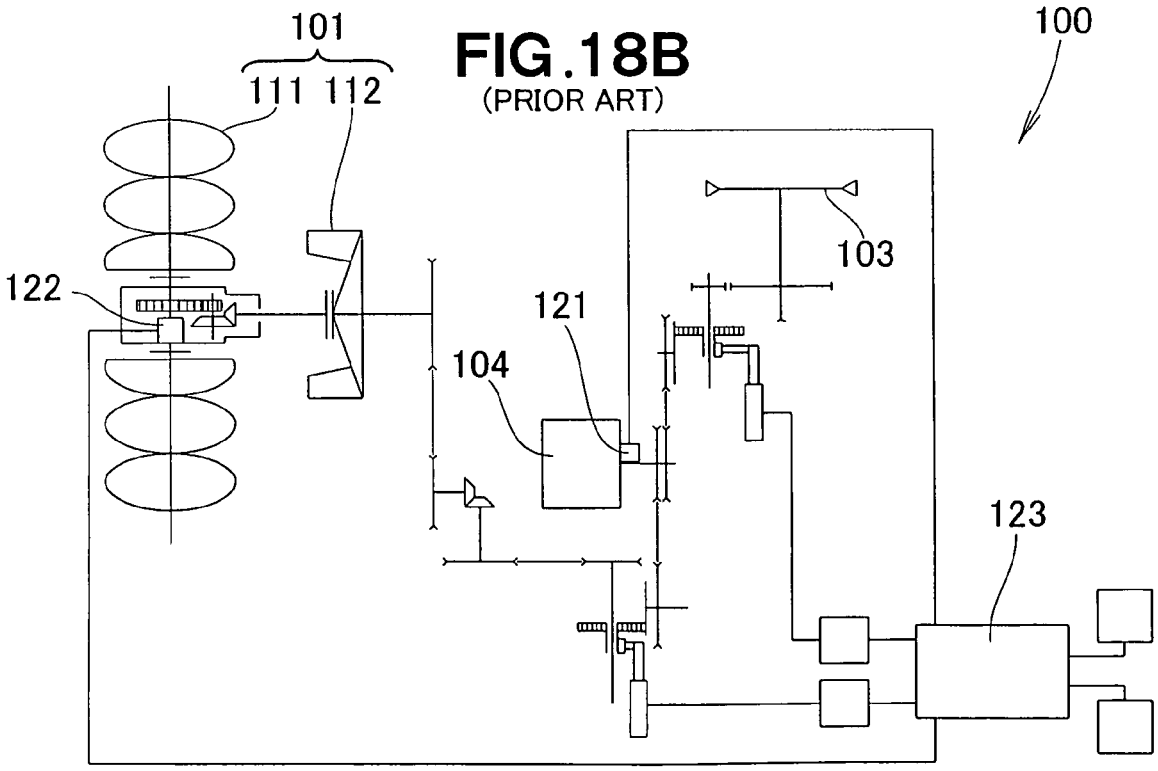
FIG.18B (PRIOR ART)
Figure 19:
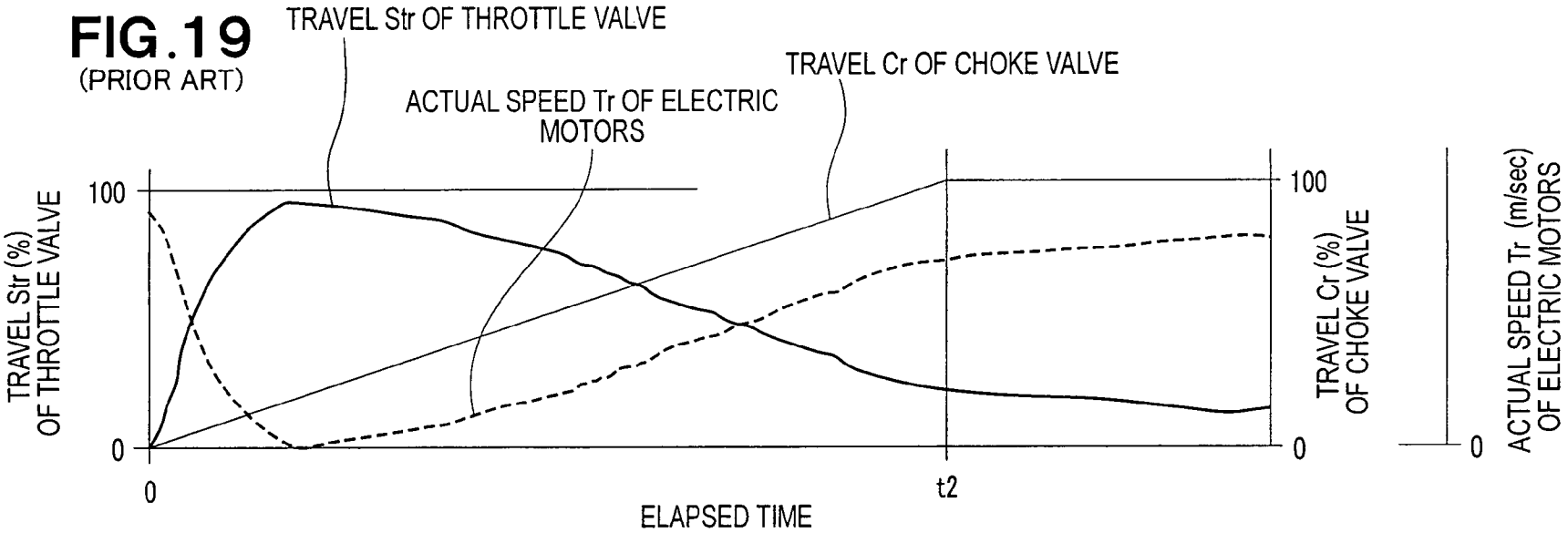
FIG.19 (PRIOR ART)
FIG. 19 is a diagram describing the performance of the conventional self-propelled work machine.
Figure 20:
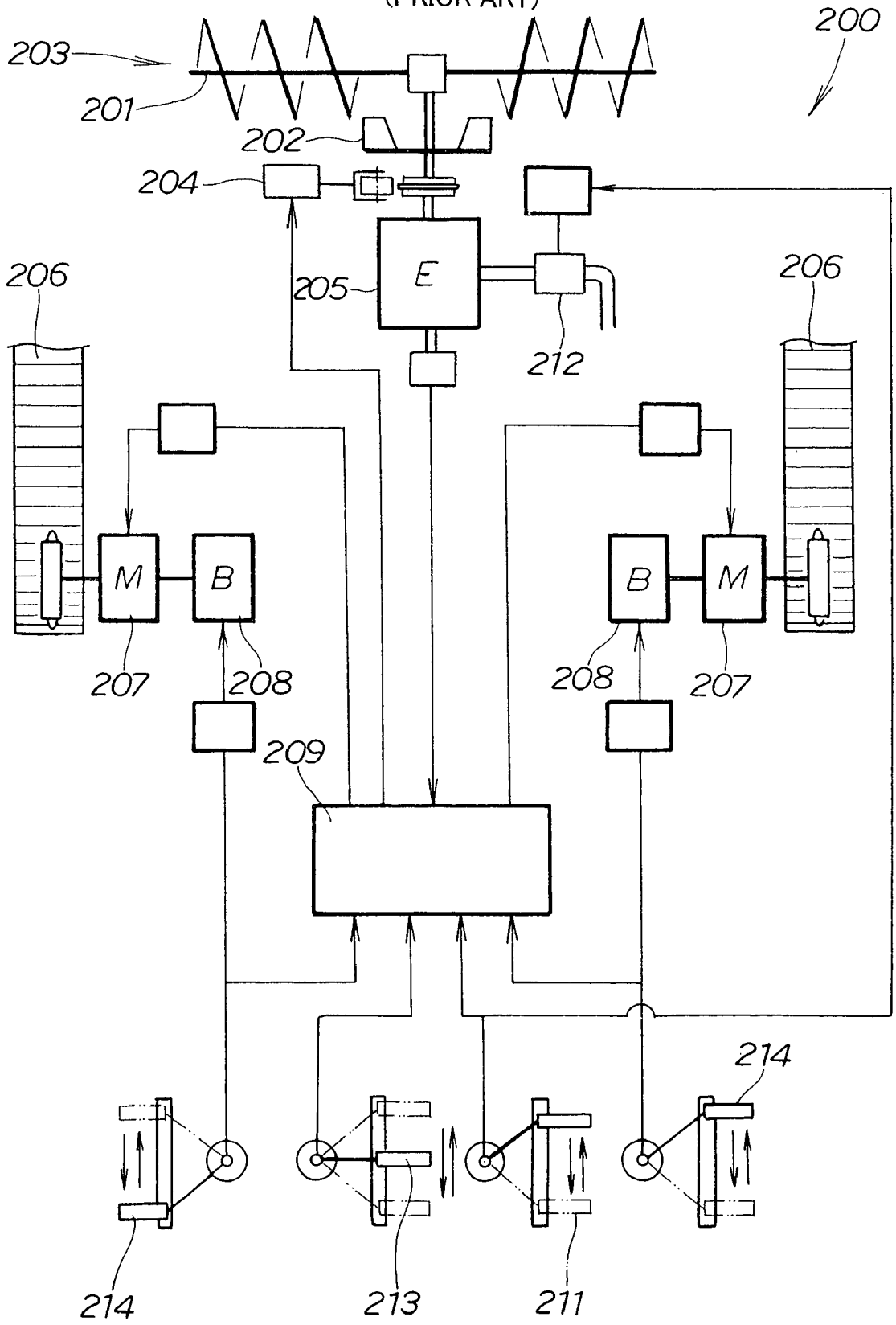
FIG.20 (PRIOR ART)
FIG. 20 is a schematic view of the conventional self-propelled work machine.
Figures 21A, 21B:
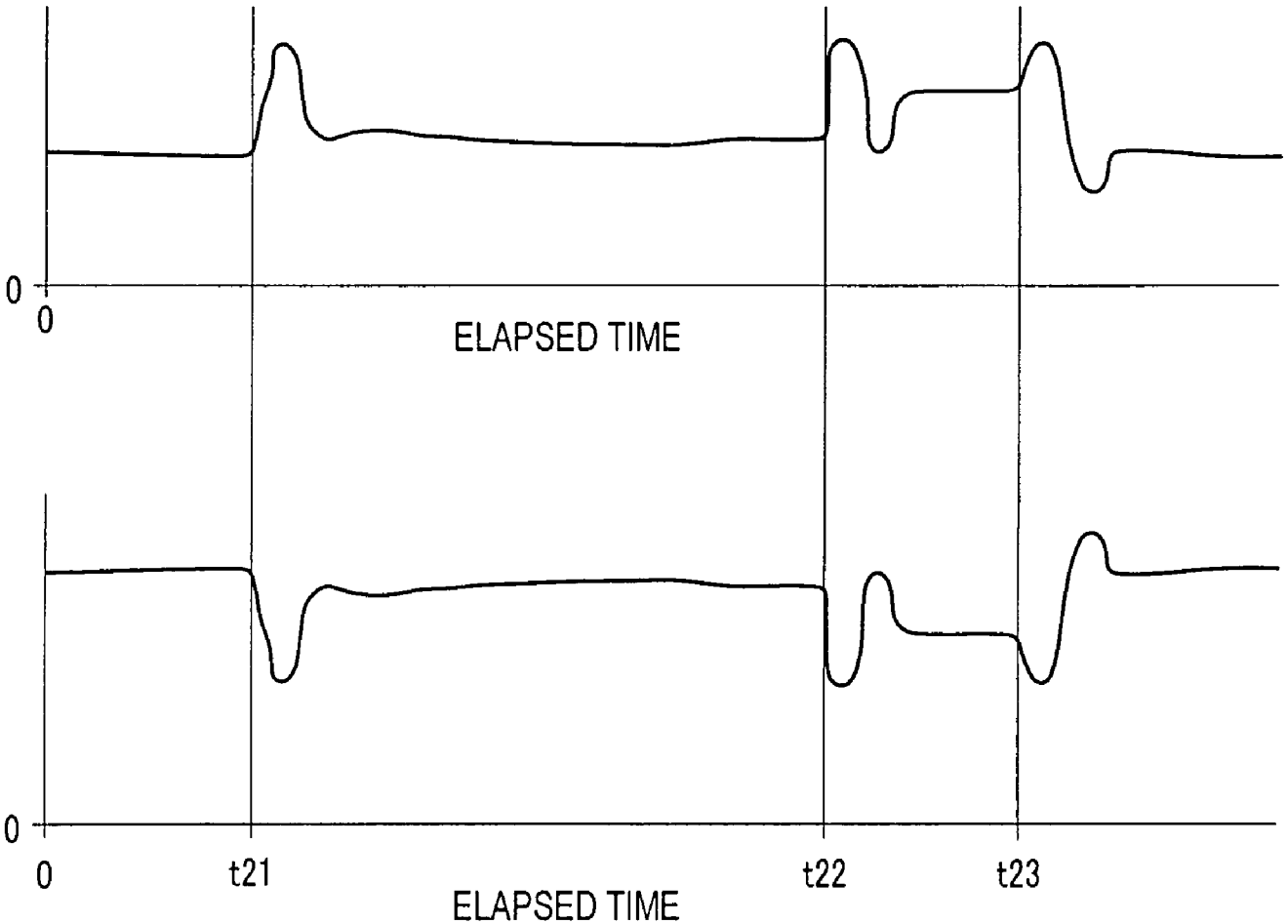
FIG.21A (PRIOR ART)
FIG.21B (PRIOR ART)
FIGS. 21A and 21B are diagrams describing the characteristics of a common self-propelled work machine.

FIG. 17A is a time chart in which the elapsed time is plotted on the horizontal axis, and the travel Str of the throttle valve 71 is plotted on the vertical axis. FIG. 17B is a time chart in which the elapsed time is plotted on the horizontal axis, and the actual speed Tr of the electric motors 21L and 21R is plotted on the vertical axis. The values shown in FIGS. 17A and 17B are correlated between these two diagrams.

At time t11 when the auger switch 45 is switched ON, i.e., at time t11 when the control unit 61 receives an operating instruction for the work unit 13, a large load is placed on the work unit 13 for an extremely brief time. As a result, the rotational speed of the engine 14 rapidly decreases for a brief time, and then rises again. The travel Str of the throttle valve 71 rapidly changes for a brief time as shown in FIG. 17A in accordance with the sudden change in the rotational speed of the engine 14.

The travel Str of the throttle valve 71 rapidly changes for a brief time at the time at which the throttle lever 52 is operated, i.e., at time t12 or t13 (the time at which the control unit 61 receives an instruction to vary the rotational speed of the engine 14) at which the travel Str of the throttle valve 71 is adjusted as shown in FIG. 17A. The travel Str of the throttle valve 71 is thus temporarily destabilized in conjunction with each instruction.

In contrast, the control unit 61 maintains the control state (ST210) that existed immediately before the instruction was received, and controls (ST218) the electric motors 21L and 21R for a specific period of time Tis (ST217 and ST219). This type of control is performed from time t11 (ST212 and ST213) at which the operating instruction and stop instruction of the work unit 13 are received from the auger switch 45, or from times t12 and t13 (ST215) at which an instruction to vary the rotational speed of the engine 14 is received from the throttle lever 52.

The control unit 61 thus controls the actual speed Tr of the electric motors 21L and 21R stably while ignoring the accompanying signal fluctuation, regardless of the manner in which the load on the engine 14 may be fluctuating during the specific time Tis elapsed from time t11, t12, or t13 at which an instruction is received to when the disorder of the travel Str is overcome. Consequently, temporary fluctuations of the travel speed in the work machine 10 can be continuously suppressed, and the travel state can be made more stable. As a result, the ease of operation of the work machine 10 can be further enhanced. Accordingly, temporary fluctuations of the travel speed in the work machine 10 can be continuously reduced, and the travel state can be made more stable. As a result, the work machine 10 can be made even easier to use.

Among the plurality of signals issued from the engine 14 to the control unit 61, the signal shown in FIG. 17A, which indicates the travel Str of the throttle valve, can be considered to be a signal (referred to as an "input signal that affects motor control") that has an effect on the control of the electric motors 21L and 21R by the control unit 61. The input signal that affects motor control may be the rotational speed signal of the engine 14 instead of the signal that indicates the travel Str.

The "specific time period Tis" herein corresponds to the time elapsed until an unstable state is overcome when the abovementioned "input signal that affects motor control" is temporarily destabilized in conjunction with at least one of instructions selected from among the instruction of the work drive instruction unit 45 (auger switch 45) and the rotational speed variation instruction of the rotational speed variation instruction unit 52 (throttle lever 52). A "specific time period Tis" that corresponds to the time until the temporary instability of the input signal is overcome is thus set based on the load characteristics of the work machine 10 and the characteristics of the engine 14 mounted thereon, and the control state that existed immediately prior to receipt of this instruction is maintained only for the duration of this specific time period Tis.

The instability of the input signal is not overcome if the "specific time period Tis" is too short, and the instability therefore has an adverse effect. When the "specific time period Tis" is too long, an old control state is continued despite the fact that the instability of the input signal has been overcome, and the response to the instruction is therefore slow.

In contrast, the optimum "specific time period Tis" in the third embodiment is set based on the load characteristics of the work machine 10 and the characteristics of the engine 14 mounted to the work machine 10. Therefore, the travel state can be stabilized even further, and the response to instructions can be adequately maintained. The specific time period Tis may be extremely short.

The control routine configuration of the third embodiment described above is best suited for application to the second control mode when a switch to the second control position P2 is made using the abovementioned mode switch 51, or the third control mode when a switch is made to the third control position P3, for example.

In the present invention, the work machine 10 may be any machine in which the load placed on the work unit 13 increases according to the travel speed, and is not limited to an auger-type snow remover.

The control unit 61 has and executes any of at least one control routine among the abovementioned plurality of control routines (control routine of the first embodiment, the second embodiment and a modified example thereof, and the third embodiment). The control unit 61 preferably has and executes any two control routines. The control unit 61 most preferably has and executes all of the control routines.

In the abovementioned control routines, the system in which the drive of the left and right electric motors 21L and 21R is controlled by the control unit 61 may be a pulse-width modulation system (PWM system) for feeding a pulse voltage to a motor terminal, for example. The motor drivers 84L and 84R may issue a pulse signal having a controlled pulse width in accordance with the control signal of the control unit 61 to control the rotation of the electric motors 21L and 21R.

Besides being directly driven and having their travel speed adjusted by the electric motors 21L and 21R as described above, the travel units 11L and 11R may also be configured in the following manner. For example, a configuration may be adopted in which the drive source of the travel units 11L and 11R is the engine 14, and the motive force of the engine 14 is transmitted to the travel units 11L and 11R via a hydrostatic CVT (continuously variable transmission). The hydrostatic CVT may be selected from generally known ones whereby left and right output shafts can be independently stopped or caused to rotate forward or backward in relation to the motive force supplied from an input shaft. The hydrostatic CVT may be configured so that the speed of rotation of the left and right output shafts is varied by varying a swash plate on the pump side using the electric motors 21L and 21R, for example. In other words, a configuration may be adopted in which the electric motors 21L and 21R can vary the travel speed of the travel units 11L and 11R.

The work machine 10 of the present invention is a self-propelled work machine in which the load placed on the work unit 13 increases according to the travel speed, and is configured so that the work unit 13 is driven by the engine 14, the travel speed of the travel units 11L and 11R can be varied by the electric motors 21L and 21R, and the travel speed is controlled in correlation with the engine 14 and the electric motors 21L and 21R. This type of work machine 10 is suitable as an auger-type snow remover whereby snow is gathered and removed by an auger at the front while the machine travels forward.

Obviously, various minor changes and modifications of the present invention are possible in light of the above teaching. It is therefore to be understood that within the scope of the appended claims the invention may be practiced otherwise than as specifically described.

What is claimed is:

1. A self-propelled work machine comprising travel units and a work unit in which a load placed on the work unit increases as the travel speed of the travel units increases, the self-propelled work machine further comprising:

electric motors for driving the travel units;

an engine for driving the work unit;

a work drive instruction unit for instructing the work unit to turn on or off; and a control unit for controlling the electric motors, wherein the control unit performs proportional-integral-derivative (PID) control in which the actual speed of the electric motors is reduced so that the actual rotational speed of the engine returns to an engine reference rotational speed when it is determined that two conditions are satisfied from among a condition wherein the instruction of the work drive instruction unit is ON, and a condition wherein the actual rotational speed of the engine is below the prescribed engine reference rotational speed when the work unit is driven by the engine.

2. The work machine of claim 1, further comprising:

a target speed adjustment unit for specifying a target speed of the electric motors, wherein the control unit performs PID control so as to maintain the actual speed of the electric motors at the target speed when it is determined that the condition wherein the instruction of the work drive instruction unit is ON is satisfied, and that the actual rotational speed of the engine has returned to the engine reference rotational speed.

3. The work machine of claim 1, wherein the control unit performs control whereby the speed of the electric motors changes to the target speed of the electric motors regardless of the actual rotational speed of the engine when the condition wherein the instruction of the work drive instruction unit is ON is not satisfied.

4. The work machine of claim 1, further comprising:

an electronic governor for adjusting the travel of a choke valve and the travel of a throttle valve in the engine, wherein the control unit performs control so as to reduce the actual speed of the electric motors in relation to an increase in the travel of the throttle valve, and performs control so as to bring the rate at which the actual speed of the electric motors is reduced relative to an increase in the travel of the throttle valve to a lower level when a startup condition wherein the choke valve is being adjusted by the electronic governor is satisfied than when this condition is not satisfied.

5. The work machine of claim 4, wherein the control unit further comprises a startup-time correction map used during startup of the engine;

the startup-time correction map has a characteristic for reducing a deceleration correction coefficient for the electric motors in relation to an increase in the travel of the throttle valve so that the deceleration correction coefficient when the throttle valve is completely open is larger than zero; and the control unit calculates the deceleration correction coefficient for the current travel of the throttle valve on the basis of the startup-time correction map, multiplies the deceleration correction coefficient by the target speed make a correction, and controls the actual speed of the electric motors at the corrected target speed when the startup condition is satisfied.

6. The work machine according to claim 4, wherein the control further comprises an initial correction map used during startup of the engine, and a normal-time correction map used after startup of the engine is completed;

the initial correction map has a characteristic whereby an initial correction coefficient for the electric motors increases in relation to an increase in the travel of the choke valve;

the normal-time correction map has a characteristic whereby a deceleration correction coefficient for the electric motors decreases in relation to an increase in the travel of the throttle valve; and the control unit calculates the correction coefficient for the current travel of the choke valve on the basis of the initial correction map, calculates the deceleration correction coefficient for the current travel of the throttle valve on the basis of the normal-time correction map, multiplies both the deceleration correction coefficient and the inverse of the initial correction coefficient by the target speed to make a correction, and controls the actual speed of the electric motors at the corrected target speed when the startup condition is satisfied.

7. The work machine of claim 4, further comprising:

a travel drive instruction unit for specifying forward movement of the travel units; wherein the control unit performs control so as to bring the rate at which the actual speed of the electric motors is reduced relative to an increase in the travel of the throttle valve to a lower level than when the choke valve is stopped, only when the three conditions are satisfied from among a condition wherein the travel drive instruction unit specifies forward movement, a condition wherein the work drive instruction unit specifies the ON state, and a condition wherein the startup condition is satisfied.

8. The work machine of claim 1, further comprising:

a rotational speed variation instruction unit for specifying a change in the rotational speed in order to change the rotational speed of the engine; wherein the control unit performs control so that the control state in which the electric motors are kept immediately prior to receiving an instruction is maintained a prescribed specific period of time from the moment at which an instruction is received when at least one of instruction is received from among the instructions of the work drive instruction unit and the rotational speed variation instruction of the rotational speed variation instruction unit.

9. The work machine of claim 8, wherein the specific period of time corresponds to the time until an unstable state is overcome when a signal that affects the control of the electric motors by the control unit and is one of the signals issued from the engine to the control unit becomes temporarily unstable in conjunction with at least one of the instructions.

10. The work machine of claim 8, wherein the control unit continuously controls the electric motors in correlation with the engine while the engine is operating.

11. A self-propelled work machine comprising:

travel units and a work unit in which a load placed on the work unit increases as the travel speed of the travel units increases; the self-propelled work machine further comprising:

electric motors for driving the travel units;

an engine for driving the work unit;

an electronic governor for adjusting the travel of a choke valve and the travel of a throttle valve in the engine;

a work drive instruction unit for instructing the work unit to turn on or off; and a control unit for controlling the electric motors, wherein the control unit performs control so as to reduce the actual speed of the electric motors in relation to an increase in the travel of the throttle valve, and performs control so as to bring the rate at which the actual speed of the electric motors is reduced relative to an increase in the travel of the throttle valve to a lower level when a startup condition wherein the choke valve is being adjusted by the electronic governor is satisfied than when this condition is not satisfied.

12. A self-propelled work machine comprising travel units and a work unit, wherein a load placed on the work unit increases as the travel speed of the travel units increases; the self-propelled work machine further comprising:

electric motors for driving the travel units;

an engine for driving the work unit;

a work drive instruction unit for instructing the work unit to turn on or off;

a rotational speed variation instruction unit for specifying a change in the rotational speed in order to change the rotational speed of the engine; and a control unit for controlling the electric motors, wherein the control unit performs control so that the control state in which the electric motors are kept immediately prior to receiving an instruction is maintained for a prescribed specific period of time from the moment at which an instruction is received when at least one instruction is received from among the instructions of the work drive instruction unit and the rotational speed variation instruction of the rotational speed variation instruction unit.

* * * * *